US006976945B1

(12) United States Patent
Lim

(10) Patent No.: US 6,976,945 B1
(45) Date of Patent: Dec. 20, 2005

(54) AB CHALLENGER EXERCISE APPARATUS PLUS

(75) Inventor: Edgar Lim, Wadsworth, IL (US)

(73) Assignee: Edgar D. Lim, Wadsworth, IL (US)

( * ) Notice: Subject to any disclaimer, the term of this patent is extended or adjusted under 35 U.S.C. 154(b) by 220 days.

(21) Appl. No.: 10/219,748

(22) Filed: Aug. 15, 2002

Related U.S. Application Data

(63) Continuation-in-part of application No. 09/864,854, filed on May 24, 2001, now Pat. No. 6,551,224, which is a continuation-in-part of application No. 09/422,671, filed on Oct. 21, 1999, now Pat. No. 6,299,570.

(51) Int. Cl.[7] ..... A63B 71/00
(52) U.S. Cl. ..... 482/148; 482/83; 482/87; 482/89
(58) Field of Search ..... 482/148, 83, 86–89; 446/491; 473/415, 447, 479, 497; 472/137; 434/248

(56) References Cited

U.S. PATENT DOCUMENTS

| | | | | | |
|---|---|---|---|---|---|
| 145,145 | A * | 12/1873 | Baggs | 119/69.5 |
| 1,177,473 | A * | 3/1916 | Bathrick | 482/87 |
| 1,582,487 | A * | 4/1926 | Shank | 482/130 |
| 1,744,594 | A * | 1/1930 | Trzesniewski | 472/126 |
| 3,050,304 | A * | 8/1962 | Hulsebus | 473/447 |
| 4,084,812 | A * | 4/1978 | Melrose et al. | 472/118 |
| 4,107,830 | A * | 8/1978 | Thomson | 29/110.5 |
| 4,403,772 | A * | 9/1983 | Stangle | 482/83 |
| 4,569,401 | A * | 2/1986 | Luck | 482/57 |
| 4,826,159 | A * | 5/1989 | Hersey | 272/146 |
| 5,080,353 | A * | 1/1992 | Tench | 482/130 |
| D335,513 | S * | 5/1993 | Gaetano | D21/787 |
| 5,460,343 | A * | 10/1995 | Hestilow | 248/124.1 |
| 5,643,182 | A * | 7/1997 | Engel | 601/119 |
| 5,853,332 | A * | 12/1998 | Briggs | 472/128 |
| 5,863,278 | A * | 1/1999 | Chen | 482/83 |
| 6,017,297 | A * | 1/2000 | Collins | 482/146 |
| 6,117,054 | A * | 9/2000 | Soltanpour | 482/83 |
| 6,280,367 | B1 * | 8/2001 | Arsenault | 482/140 |
| 6,299,570 | B1 * | 10/2001 | Lim | 482/148 |
| 6,338,686 | B1 * | 1/2002 | King | 473/415 |
| 6,348,028 | B1 * | 2/2002 | Cragg | 482/148 |
| 6,558,295 | B2 * | 5/2003 | Araki et al. | 482/35 |

* cited by examiner

*Primary Examiner*—Stephen R. Crow
*Assistant Examiner*—L. Amerson

(57) ABSTRACT

A modified exercise apparatus is described which has adjustable attachments for speedbags, basketball rims and a horizontal footstand support bar. There are also basketball rim cords by which the user can face outwardly from the device, rest his or her upper body on the horizontal footstand support bar, and perform exercises.

20 Claims, 17 Drawing Sheets

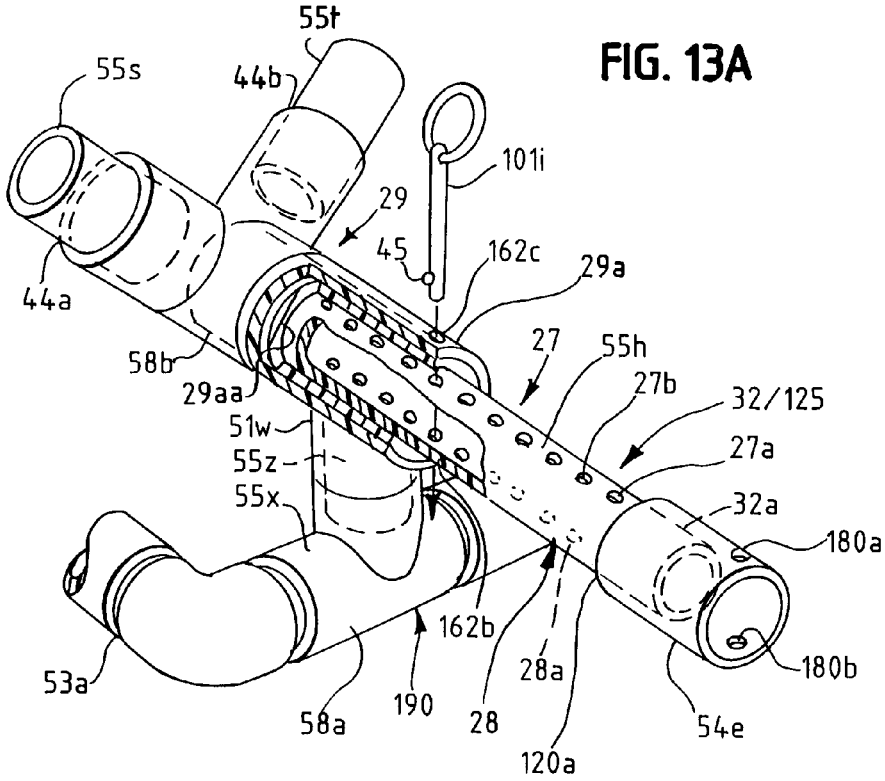
FIG. 13A
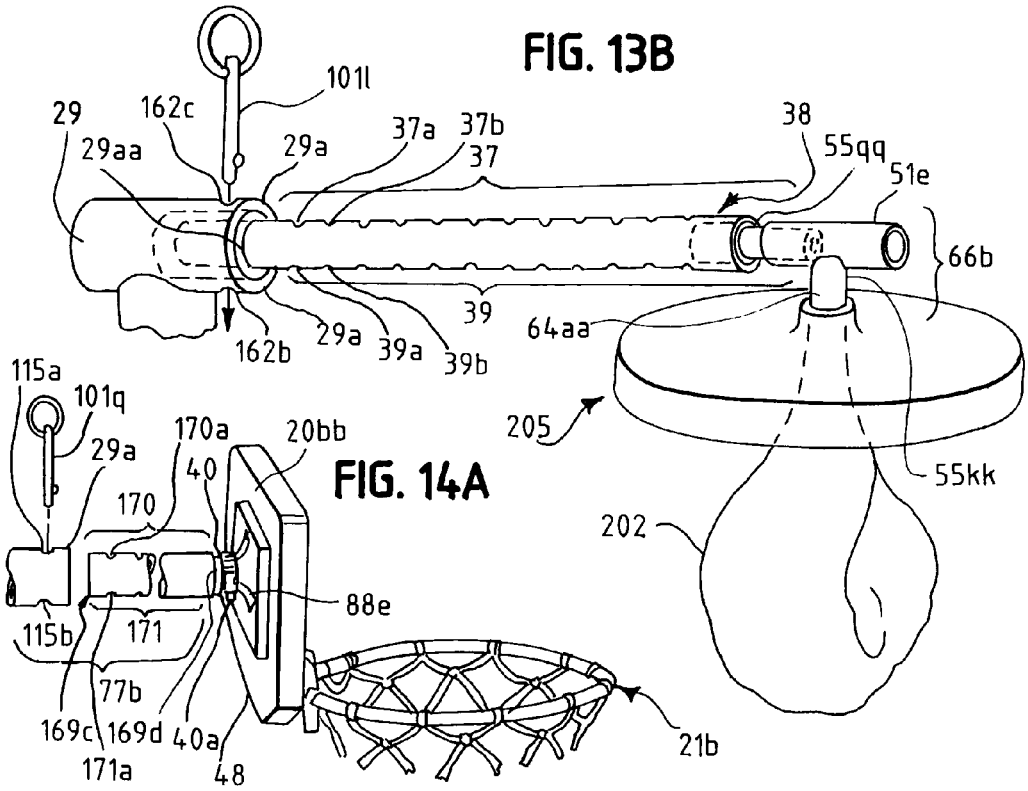
FIG. 13B
FIG. 14A

AB CHALLENGER EXERCISE APPARATUS PLUS

This application is a continuation in part of U.S. patent application Ser. No. 09/864,854 filed May 24, 2001 now U.S. Pat. No. 6,551,224, which is a continuation in Part of U.S. patent application Ser. No. 09/422,671 filed Oct. 21, 1999 (now U.S. Pat. No. 6,299,570 B1).

BACKGROUND OF THE INVENTION

Modified improved AB Challenger exercise device strengthens abdominal and rib muscles, as well as fine movement muscles of the hands and feet. Specific muscles affected by my stationary apparatus include rectus abdominus muscles, external and internal obliques and serratus anteriors, adductor muscle (inner thigh), anterior deltoids and flexor hand groups.

In the past structurally complex and bulky exercise devices have not adapted easily to use in a small space, such as the user's apartment. U.S. Pat. No. 4,9733,832(Dalebout) discloses a machine for rowing-type exercises using a slant board. U.S. Pat. No. 3,958,806 disclose a barrel ball game with several spaced baskets. A series of manually actuated ball assemblies are arranged to place the ball towards one of these baskets.

U.S. Pat. No. 5,074,552 (Gomez et al.) discloses a basketball-type apparatus with a hoop mounted a backboard. The backboard to offset from a rotary drive system carries the backboard and hoop through a horizontally disposed arc.

U.S. Pat. No. 5,035,423 (Arciniega) discloses a basketball training facility, which comprises an enclosed area. There is also a ball return device, a selectively rotating basketball goal, and a track mounted motor driven carriage. U.S. Pat. No. 5,246,225(Matherne et al.) discloses a fordable arcade game apparatus and method for games with a ball and upright support portion.

U.S. Pat. No. 5,443,259 (Segal et al.) discloses a game apparatus, which combines pinball, target bowling and basketball games within a single assembly. It also has a common scorekeeping and control system.

The above devices do not maintain strength of specific muscle groups. They also are not lightweight, economical to purchase and maintain, nor are they as well adapted to use by convalescing individuals as my device.

SUMMARY OF THE INVENTION

My modified AB Challenger exercise apparatus exercises the rectus abdominus muscles, external and internal obliques, anterior deltoids and serratus anterior (rib muscles) with speedbags in the preferred embodiment. In other embodiments, basketball hoops, described in detail infra can replace the speedbags. My apparatus effectively exercises fine movement muscles such as hands and feet, with elevated and appropriately sized speedbags.

In the preferred embodiment my exercise device also strengthens abdominal muscles by appropriate exercises. The muscles most benefited are the rectus abdominus, and external and internal obliques. However, my preferred embodiment also strengthens neck and upper body muscle groups. These muscles include those of the upper body trunk such as: sternocleidomastoid, scalenes, upper trapezius, pectoralis (major and minor), anterior deltoids, serratus anterior, triceps, adductor muscles and flexor hand groups.

My preferred embodiment comprises three spaced speedbags with rigid styrofoam discs. All three speedbags are equal in size and shape in the preferred embodiment. However, differently sized and shaped speedbags are also within the scope of my invention. The central speedbag is adjustable in an anterior/posterior direction, while lateral speedbags are adjustable laterally. Each lateral speedbag is approximately sixty degrees from the central speedbag. However, lateral speedbags are adjustable to more or less than a sixty degree angle in all my embodiments.

Accordingly, one goal of my invention is to provide a practical device with which a convalescing individual exercises numerous muscle groups;

Another goal of my invention is to provide a cost-effective device by which a person strengthens muscle groups simultaneously;

These goals and other advantages within the scope of my invention become more apparent in the drawings and detailed description of the invention, infra.

BRIEF DESCRIPTION OF THE DRAWINGS

FIG. 13A: Isolated perspective view of central prong/anterior-posterior adjuster bar and common stem.

FIG. 13B: Isolated lateral view of central speedbag attachment and attachment structure.

FIG. 14A: Isolated view of central prong conventional basketball rim and attachment structure.

DETAILED DESCRIPTION OF THE PREFERRED EMBODIMENT AND OTHER EMBODIMENTS

Introduction

Figure 1:
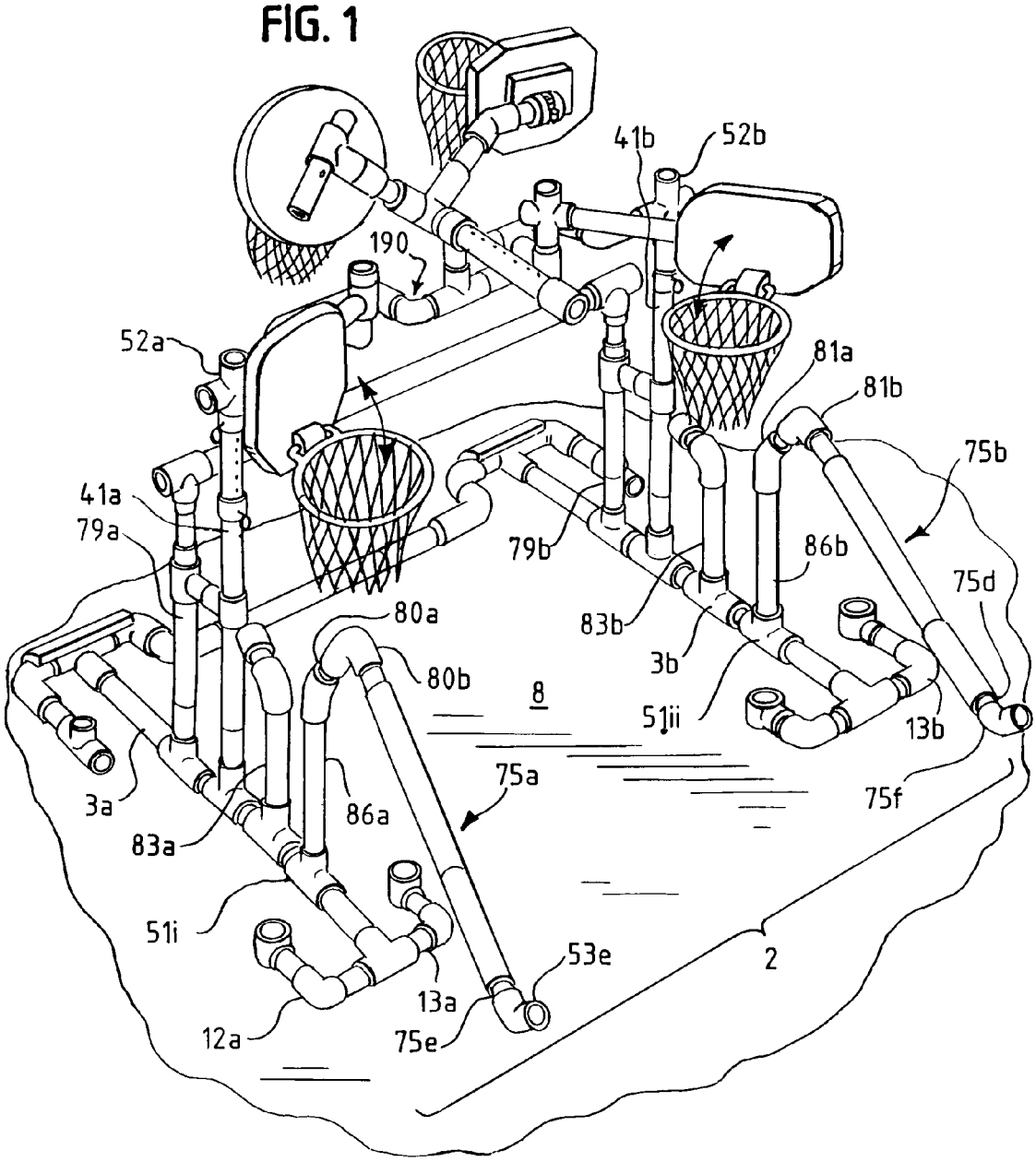
FIG. 1: Anterior perspective view of modified AB Challenger exercise apparatus in the preferred embodiment.
Figure 3:
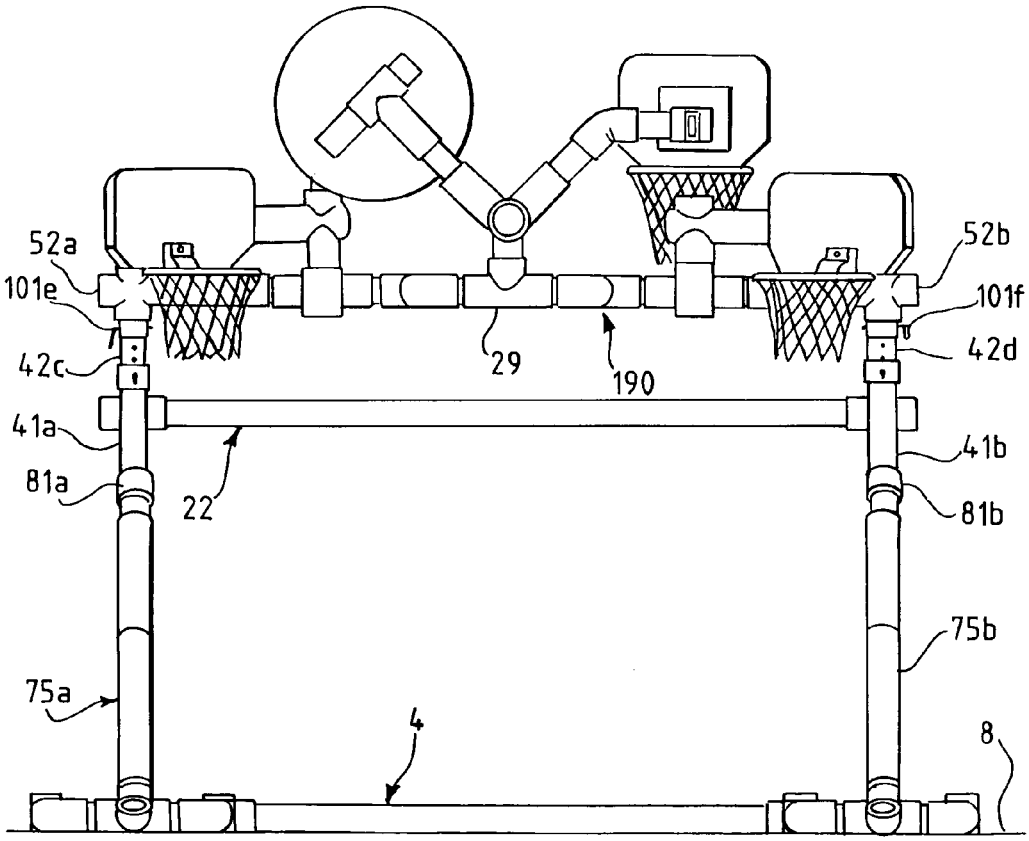
FIG. 3: Anterior view of components of modified AB Challenger.

Referring initially to FIGS. 1 and 3, the lower structural portion of my modified speedbag AB Challenger 10 comprises a base 2. Base 2 comprises upwardly protruding first and second vertical speedbag support bars 41*a*, 41*b* respectively, each with an upper attached four-member cross connectors 52*a*, 52*b*. There are also vertical footstand support bars 79*a*, 79*b*, as well as vertical speedbag support stands 83*a*, 83*b* and pivoting arm grips 75*a*, 75*b*.

Still referring to FIG. 1, the upper portion of my invention comprises a rigid horizontal speedbag support bar 190. There are also angular, vertical and posterior-anterior height and/or length adjusters for spatial adjustments of speedbags 201, 202, 203 (not seen), as well as basketball rims (not seen). The overall structure and design of my modified AB challenger exercise device 11 is bilaterally symmetrical.

Lower Portion of Modified AB Challenger Exercise Apparatus 11

Base 2

Figure 2:
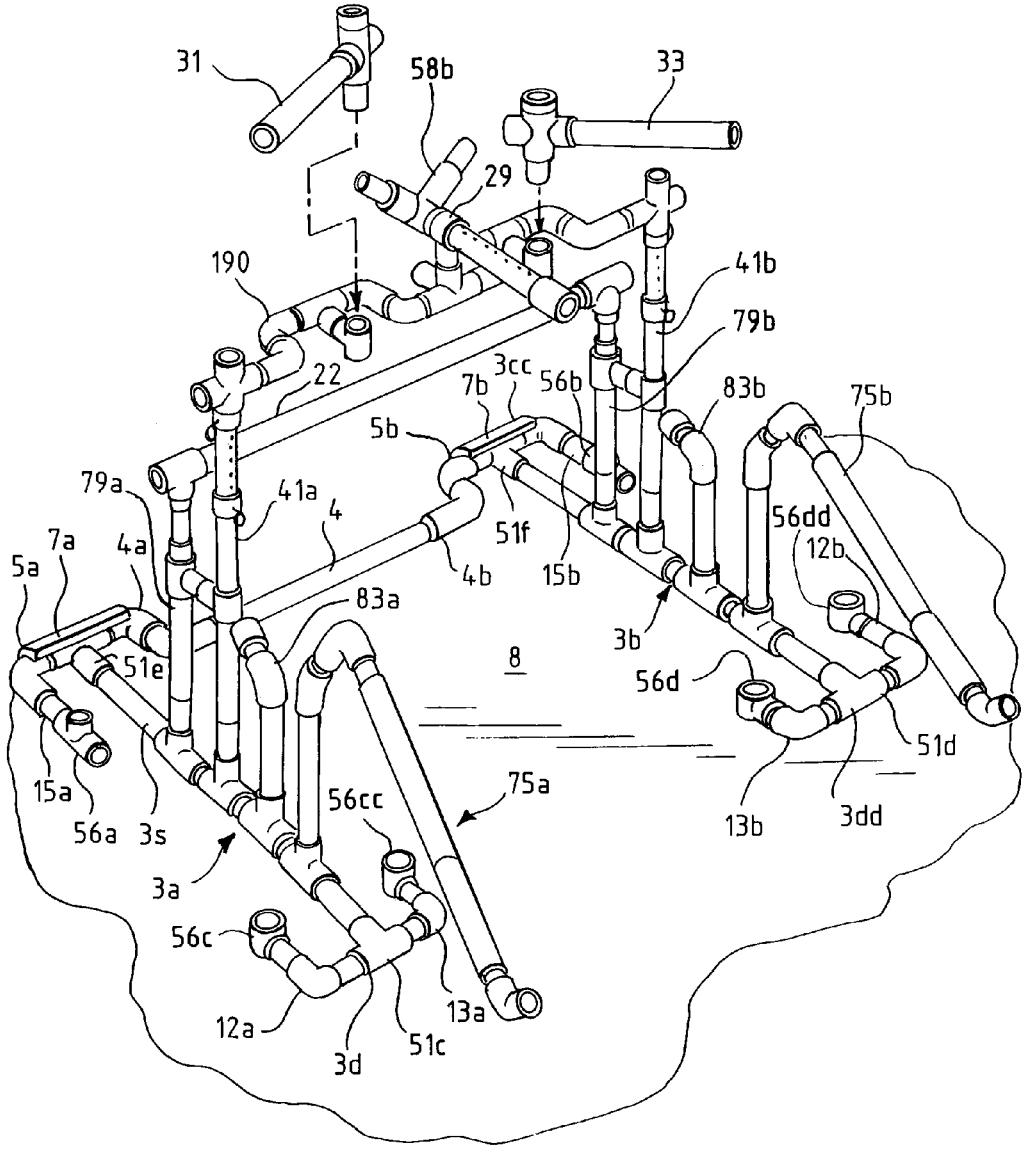
FIG. 2: Anterior perspective view of modified AB Challenger with removable components.

FIG. 2 illustrates base 2, as well as horizontal base bar 4 most posteriorly; horizontal footstand bar 22, and arm grips 75*a*, 75*b* more anteriorly. Most anteriorly, base 2 comprises first and second angled interior opposing extension bars 13*a*, 13*b* respectively and first and second exterior angled segments 12*a*, 12*b* respectively.

The distance between extension bars 13 *a*, 13*b* is approximately three feet. This measurement is approximately the width of a standard exercise mat width, thus making this distance ideal for the reclining user, infra.

First and second longitudinal grips 7*a*, 7*b* respectively, for wall protection, are located at connecting segments 5*a*, 5*b*. First and second armgrips 75*a*, 75*b* respectively are anteriorly positioned upon the upper surface of first and second anterior-posterior parallel base bars 3*a*, 3*b* respectively.

The preferred longitudinal grips 7*a*, 7*b* are made of rubber and are available from:

Home Depot
655 Lake Cook Road
Deerfield, Ill.
Phone: 847-564-8601

Horizontal Base Bar 4

Referring to FIG. 2, horizontal base bar 4, flush along horizontal flat rigid support surface 8, preferably attaches to first and second parallel anterior-posterior base bars 3*a*, 3*b* respectively. This attachment is by one angled connector 53*c* and one adjacent 2-ended linear connector 54*a* (not seen) respectively at each horizontal end 4*a*, 4*b*. First and second adjacent angled opposing extension bars 15*a*, 15*b* terminate in first and second upwardly protruding coffee cup connectors 56*a*, 56*b* respectively.

First and Second Anterior/Posterior Parallel Base Bars 3*a*, 3*b*

Figure 7:
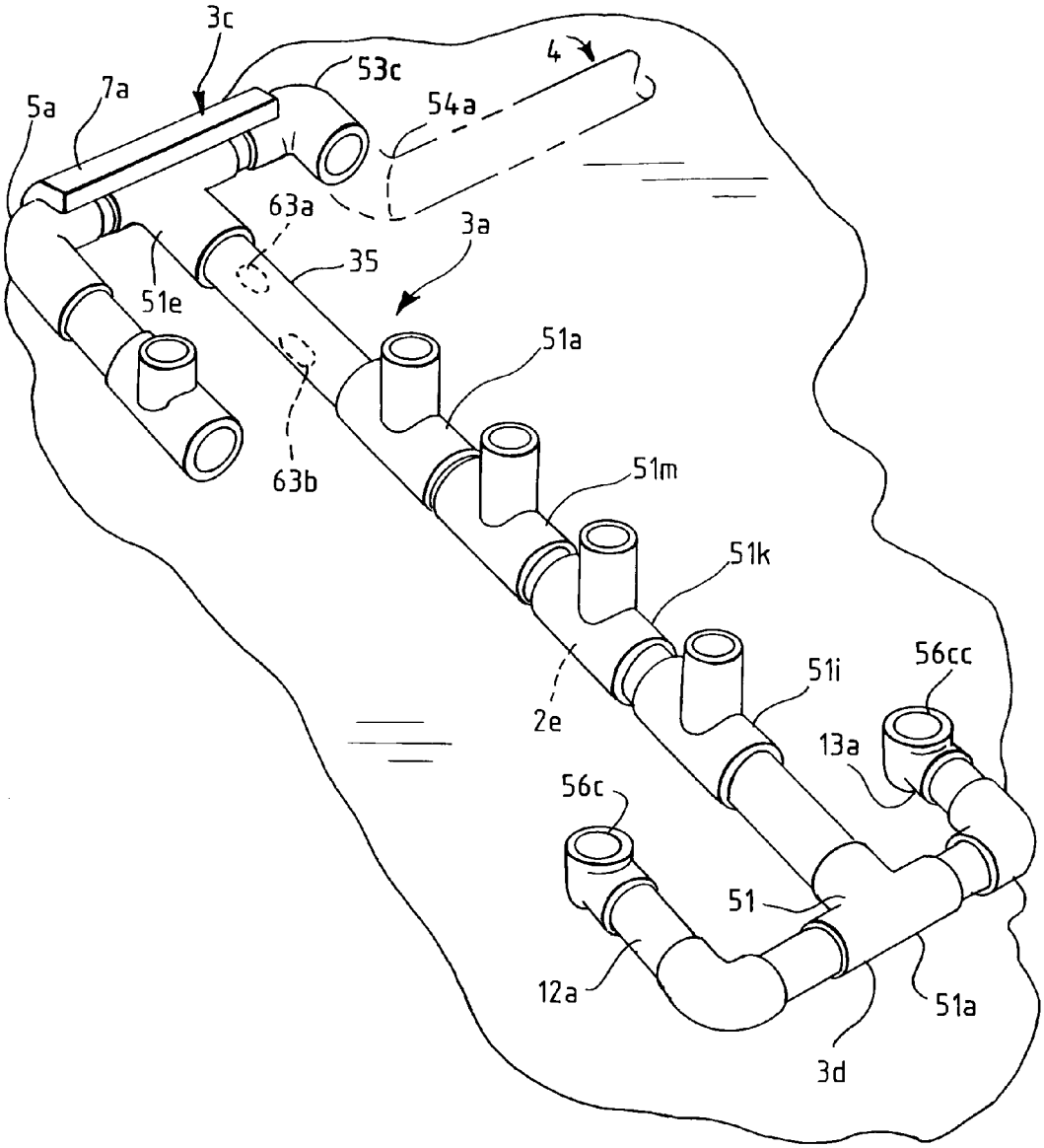
FIG. 7: Isolated anterior perspective view of one anterior-posterior parallel base bar without vertical components.

As best seen in FIGS. 2 and 7, at anterior ends 3*d*, 3*dd* of each base bar 3*a*, 3*b* are first and second angled exterior segments 12*a*, 12*b*.

Each angled segment 12*a*, 12*b* is continuously connected to its anterior-posterior parallel base bar 3*a*, 3*b* respectively by first and second base bar t-joint connectors 51*c*, 51*d* respectively. Exterior angled segments 12*a*, 12*b* contribute lateral support to modified AB Challenger exercise device 11. Each first and second parallel anterior-posterior base bar 3*a*, 3*b* also has a first and second parallel posterior end 3*c*, 3*cc* respectively.

First and second anterior-posterior parallel base bars 3*a*, 3*b* respectively preferably attach by first and second opposing t-joint connectors 51*e*, 51*f* to angled connector 53*c* and two-end linear connector 54*a* adjacent horizontal base bar 4. Each adjacent angled connector 53*c* and linear connector 54*a* contains an adhered short pipe segment 55 for strength (not seen). Each parallel bases bar 3*a*, 3*b* supports the lower ends of vertical support pipes, and each parallel base bar 3*a*, 3*b* are the mirror image of the other.

In the preferred embodiment, each polyvinyl chloride (PVC) pipe comprising anterior-posterior parallel base bars 3*a*, 3*b* is approximately 18(eighteen) inches in length. Each base bar 3*a*, 3*b* preferably comprises a hollow inner diameter of approximately 2 and ½ inches. Angled segments 12*a*, 12*b*, parallel base bars 3*a*, 3*b* and connecting segments 5*a*, 5*b* preferably are polyvinyl chloride pipe and/or prefabricated connectors.

Upwardly Protruding Vertical Components Along Base Bars 3*a*, 3*b*

Figure 4:
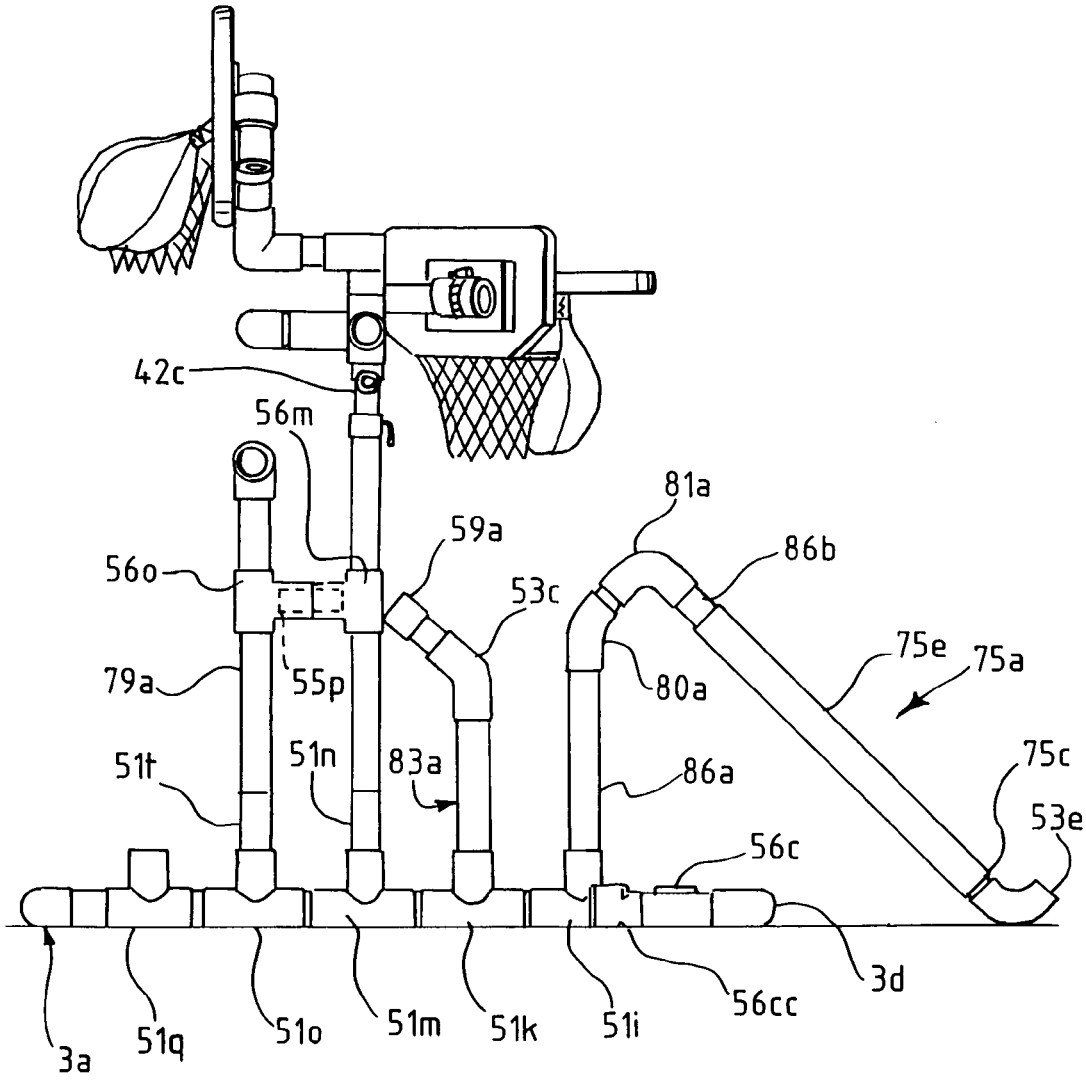
FIG. 4: Lateral view of vertical components attached to one parallel base bar.

FIG. 4 is a lateral view of first anterior/posterior parallel base bar 3*a* and attached upwardly protruding vertical components in the preferred embodiment. The components shown in FIG. 4 for base bar 3*a* are identical for second anterior-posterior parallel base bar 3*b* as to sequence, structure and orientation. Please see FIGS. 1 and 2.

As best seen in FIGS. 7 and 2, beginning at anterior base bar ends 3*d*, 3*dd* are first and second base coffee cup connectors 56*c*, 56*cc*, 56*d*, 56*dd*(generically 56). Each coffee cup connector 56 is attached, preferably with P4 PVC cement, to the terminal ends of first and second angled segments 12*a*, 12*b* and 13*a*, 13*b* (generically angled segments 12, 13).

As best seen in FIGS. 2 and 4, Immediately posterior to the junction of angled segments 12, 13 are first and second arm grips 75*a*, 75*b* respectively. Upwardly protruding arm grips 75*a*, 75*b* are reversibly attached at their lower ends within first and second grip t-joint connectors 51*i*, 51*ii* respectively. Each arm grip 75*a*, 75*b* comprises first and second angled connectors 80*a*, 80*b*, 81*a*, 81*b*, as well as one straight segment 86*a*, 86*b*. Each grip 75*a*, 75*b* also has a foot comprising a third angled connector 53*e*.

As best seen in FIGS. 1 and 4, immediately posterior to armgrips 75*a*, 75*b* respectively, and attached within adjacent sixth and seventh t-joint connectors 51*k*, 51*kk* respectively, are first and second angled adjacent support pipes 83*a*, 83*b* respectively.

Still referring to FIGS. 1 and 4, each adjacent support pipe 83*a*, 83*b* contacts the anterior surface of first and second upwardly protruding rigid vertical speedbag support pipe 41*a*, 41*b* respectively. Each support pipe 83*a*, 83*b* comprises an angled connector 53*c*, 53*cc* respectively and an adjacent upper cap 59*a*, 59*b* respectively. Posterior to each support pipe 83*a*, 83*b* are first and second upwardly protruding rigid vertical speedbag support pipes 41*a*, 41*b* respectively. The lower end of each pipe 41*a*, 41*b* inserts within fifth and sixth t-joint connectors 51*m*, 51 mm respectively and adjoining two-end linear connectors 51*n*, 51*nn* respectively along each parallel base bar 3*a*, 3*b*.

Still referring to FIGS. 2 and 4, immediately posterior to each vertical first and second rigid speedbag support pipe 41*a*, 41*b* along anterior-posterior parallel base bar 3*a*, 3*b* respectively are vertical rigid upwardly protruding footstand support pipes 79*a*, 79*b* respectively. The lower end of each pipe 79*a*, 79*b* fits within seventh and eighth two-ended linear connector 54*t*, 54*tt* respectively and ninth and tenth adjoining t-joint connectors 51*o*, 51*oo* respectively. One short pipe segment 55 (not seen) is adhered within each respective pair of connectors 54*t*, 51*o*, 54*tt*, 51*oo*.

Referring again anteriorly and still referring to FIGS. 2 and 4, movable intermediate pipe segments 59*a*, 59*b*(not seen) reversibly insert into anterior coffee cup connectors 56*c*, 56*cc*. T-joint connectors 51*q*, 51*qq* are each terminal structures on posterior bar segments 5*a*, 5*b*. Moveable intermediate pipe segments 59 are optional storage structures for basketball and speedbag attachment structures, infra.

The above description of bar 3*a*, 3*b* vertical components represents the preferred embodiment. Other combinations or types of connectors, as well as other posterior/anterior alignment of vertically extending components, and varieties of permanent attachment, are also within the scope of my invention. In the preferred embodiment, however, each generic t-joint connector 51 is permanently adhered to each respectively base bar 3*a*, 3*b*. Each linear generic segment 54 is rigidly connected to each adjacent t-joint connector 51 by a permanently adhered short pipe segment 55 within adjacent connectors 51, 54.

These vertical components are discussed in more detail, infra.

Footstand Bars

Horizontal Footstand Support Bar 22

Figure 8:
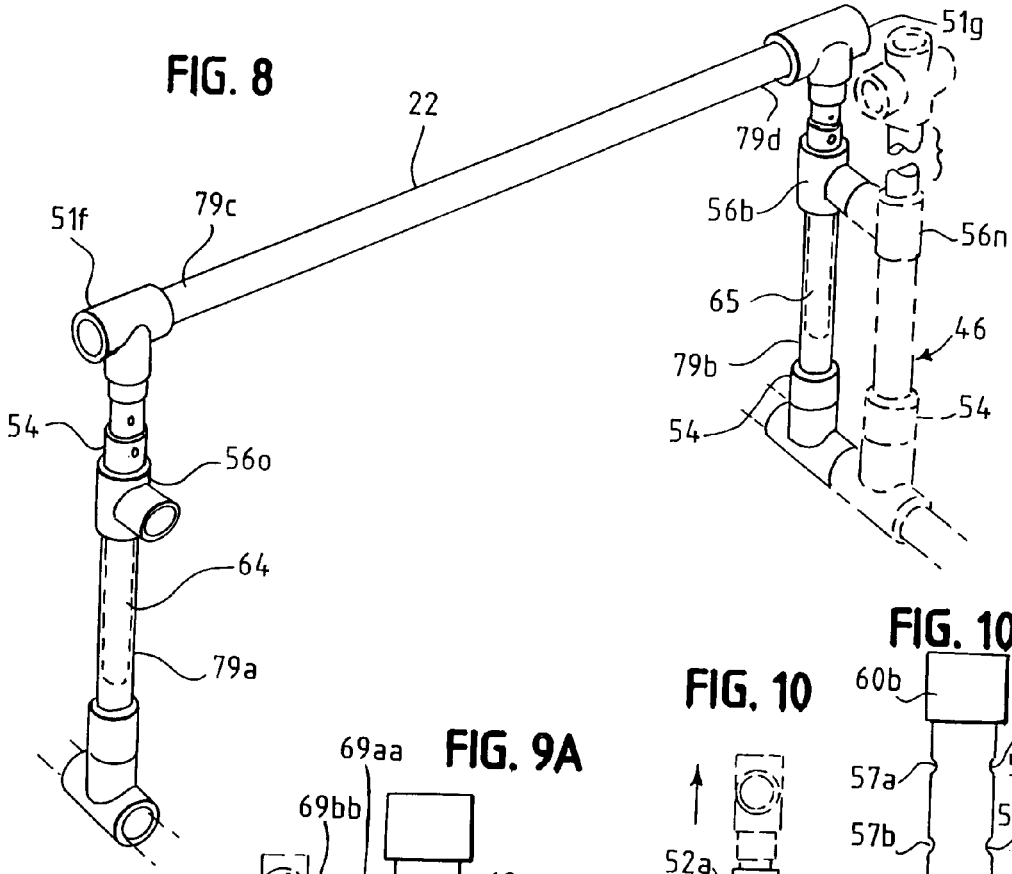
FIG. 8: Close-up isolated partial anterior view of rigid horizontal footstand support bar.

Referring now to FIGS. 2 and 8, horizontal footstand support bar 22 lies immediately above and perpendicular to, first and second parallel base bars 3*a*, 3*b* respectively. Horizontal footstand support bar 22 is approximately 3.1 feet in length, and bar 22 has a first bar end 79*c* and a second bar end 79*d*.

Horizontal footstand support bar 22 is also approximately 3.3 feet above a rigid horizontal supporting surface 8. However, the length of horizontal footstand support bar 22 can vary and still remain within the scope of my invention.

Vertical Footstand Support Bars 79*a*, 79*b*

Figure 9:
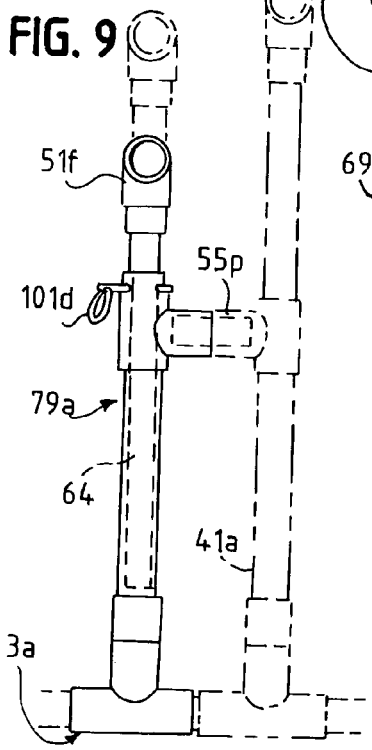
FIG. 9: Isolated lateral close-up view of vertical footstand support bar with adjacent phantom vertical upwardly protruding speedbag support bar.

Referring now to FIGS. 8 and 9, each vertical footstand support bar 79*a*, 79*b* is preferably approximately one foot in height, but other lengths are also within the scope of my invention. Each first and second two t-joint connectors 51*f*, 51*g* respectively attach horizontal support bar 22 to first and second vertical footstand support bar 79*a*, 79*b* at respective footstand ends 79*c*, 79*d*.

Vertical Footstand Height Adjuster Bars 64,65

Still referring to FIGS. 8 and 9, inserted into each t-joint connector 51*f*, 51*g* are upper ends of first vertical footstand height adjuster bar 64 and a second vertical footstand height adjuster bar 65 respectively. Each vertical footstand height adjuster bar 64,65 is approximately fifteen inches long, but other lengths are also satisfactory in other embodiments. Each vertical height adjuster bar 64,65 also slidably moves vertically within each vertical footstand support bar 79*a*, 79*b*.

Figure 9A:
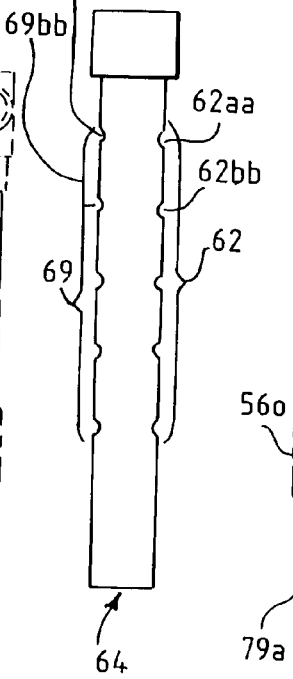
FIG. 9A: Close-up isolated lateral view of vertical footstand adjuster bar.

Referring now to FIGS. 9 and 9A, each vertical height adjustor bar 64, 65 comprises two vertically aligned parallel rows of pinholes: 62*aa*, 62*bb*, 62*cc*, etc. (generically pinholes 62) and 69*aa*, 69*bb*, 69*cc*, etc. (generically pinholes 69). Linearly aligned pinholes 62, 69 within each vertical footstand adjuster bar 64,65 respectively are approximately ½ inch apart from each adjoining pinhole. Each linear pinhole set 62 opposes linear pinhole set 69 in the same adjuster bar by approximately 180 degrees in the preferred embodiment. Bar 65 is not shown, but is identical in structure and function to adjuster bar 64.

To change the height of horizontal footstand support bar 22, the user manually pulls or pushes each vertical footstand adjuster bar 64,65 interior to, or exteriorly from, each respective vertical footstand support bar 79*a*, 79*b*. For example, at a new predetermined height pinholes 62*c*, 69*c* emerge from the upper end of each vertical footstand support bar 79*a*, 79*b*(when each vertical footstand support bar 64,65 is pulled upwardly). When inserted through pinholes 62*c*, 69*cc* a rounded long metal pin 101*d* becomes a backstop and prevents slippage of support bar 22 from its new vertical position.

Arm Grips 75*a*, 75*b*

Referring again to FIGS. 1, 2 and 4, each symmetrically opposing first pivoting arm grip 75*a* and second pivoting arm grip 75*b* comprise two angled joints 80*a*, 80*b* and 81*a*, 81*b* respectively. Each pivoting arm grip 75*a*, 75*b* also comprises first and second angled connector 53*e*, 53*ee* respectively at each first and second distal end 75*c*, 75*d* respectively of each second straight segment 75*e*, 75*f* respectively.

Upper angled connectors 80*a*, 81*a* attach to straight segments 86*a*, 86*b* respectively. Each straight segment 86*a*, 86*b* reversibly inserts into upwardly protruding t-joint connector 51*i*, 51*ii*, which in turn permanently encircle a corresponding anterior/posterior first and second parallel base bar 3*a*, 3*b*. Arm grips 75*a*, 75*b* swivel at upper angled connectors 81*a*, 81*b* respectively. Distal ends 75*c*, 75*d* rest upon rigid supporting horizontal surface 8.

Circular Rubber Grips 63

Referring now to FIG. 7, circular rubber grips 63*a*, 63*b*, etc. (generically circular grips 63) are permanently adhered along bottom surface 2*e* of anterior-parallel base bars 3*a*,3*b*. Each circular rubber grip 63 is approximately 1.5 inches in diameter in the preferred embodiment. Each grip 63 is permanently affixed to lower surface 2*e* with a suitable adhesive, preferably P4 PVC cement.

However, other adhesives, diameters, shapes and numbers of rubber grips 63 are within the scope of my invention. Circular rubber grips 63 prevent damage to furniture, floors and walls in areas in which my apparatus 11 is located. Circular rubber grips 63 are available from:

Shepherd Hardware Products
3 Oaks, Mo. 49128
Phone: 1-616-756-3830 and are sold as non-stick self-adhesive foam pads.

Upwardly Protruding Rigid Vertical Speedbag Support Bars 41*a*, 41*b*

Referring now to FIGS. 1 and 3, rising vertically from first and second parallel base bars 3*a*, 3*b* are first upwardly protruding vertical rigid speedbag support bar 41*a* and second upwardly protruding vertical rigid speedbag support bar 41*b* respectively. Each first and second four member cross connector 52*a*, 52*b* respectively contains a permanently first and second adhered speedbag vertical height adjuster bar 60,61. See also FIGS. 10 and 10A.

The upper end of each speedbag vertical height adjuster bar 60,61 is reinforced by first and second detente rounded metal pins 101*f*, 101*g* (not seen) respectively within each four member cross connector 52*a*, 52*b* respectively. Each four-member cross connector 52*a*, 52*b* also contains first and horizontal ends 190*a*, 190*b* of horizontal rigid speedbag support bar, infra. Upwardly protruding vertical speedbag support bars 41*a*, 41*b* are hollow and each bar 41*a*, 41*b* is approximately 24 inches in length in the preferred embodiment. However, other lengths are acceptable in other embodiments.

Figure 10:
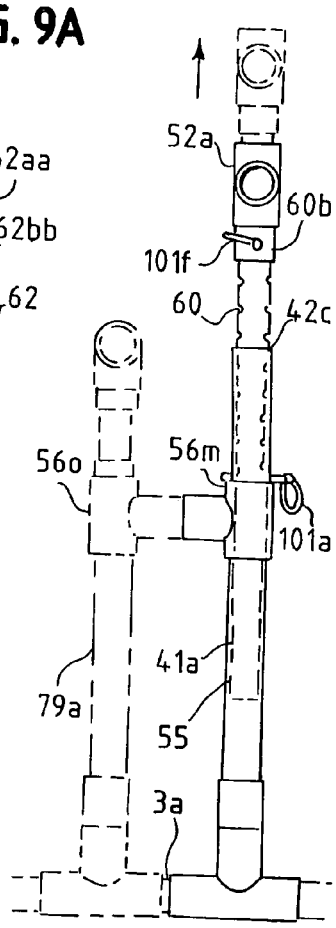
FIG. 10: Isolated close-up lateral view of vertical footstand bar in phantom, with upwardly protruding vertical speedbag support bar and enclosed vertical speedbag height adjuster bar.

Referring now to FIGS. 4 and 10, approximately ⅓ towards upper ends of each vertical speedbag support bar 41*a*, 41*b* respectively, are first horizontal coffee cup connector 56*m* and second horizontal coffee cup connector 56*mm* respectively. Although FIG. 10 only represents support bar 41*a*, support bar 41*b* has the same structure, function and relationship to adjacent components.

Each coffee cup connector 56*m*, 56 mm attaches to a third horizontal coffee cup connector 56*o* and fourth horizontal coffee cup connector 56*oo* respectively (generically horizontal coffee cup connectors 56).

Third and fourth connectors 56 respectively, encircle vertical footstand support bars 79*a*, 79*b* respectively. A short horizontal pipe segment 55*p* lodges within each pair of horizontal coffee cup connectors 56 to prevent wobble.

Still referring to FIGS. 1, 4, and 10, each upwardly protruding vertical speedbag support bar 41*a*, 41*b* comprises a single upper end 42*c*, 42*d* respectively. First and second speedbag support stands 83*a*, 83*b* contact upwardly protruding vertical speedbag support bars 41*a*, 41*b* respectively. Support stands 83*a*, 83*b* statically oppose forces upon bars 41*a*, 41*b* at uppermost caps 59*a*, 59*b* respectively. Although FIG. 4 only illustrates vertical components along anterior-posterior parallel base bar 3*a*, the structure, sequence and function of structures along anterior-posterior parallel base bar 3*b* are the same, and reference numbers, such as 3*b*, 75*b*, etc. correspond to identical structures and identically situated components.

Upper Portion Of Modified Speedbag AB Challenger

Horizontal Rigid Speedbag Support Bar 190

Figure 5:
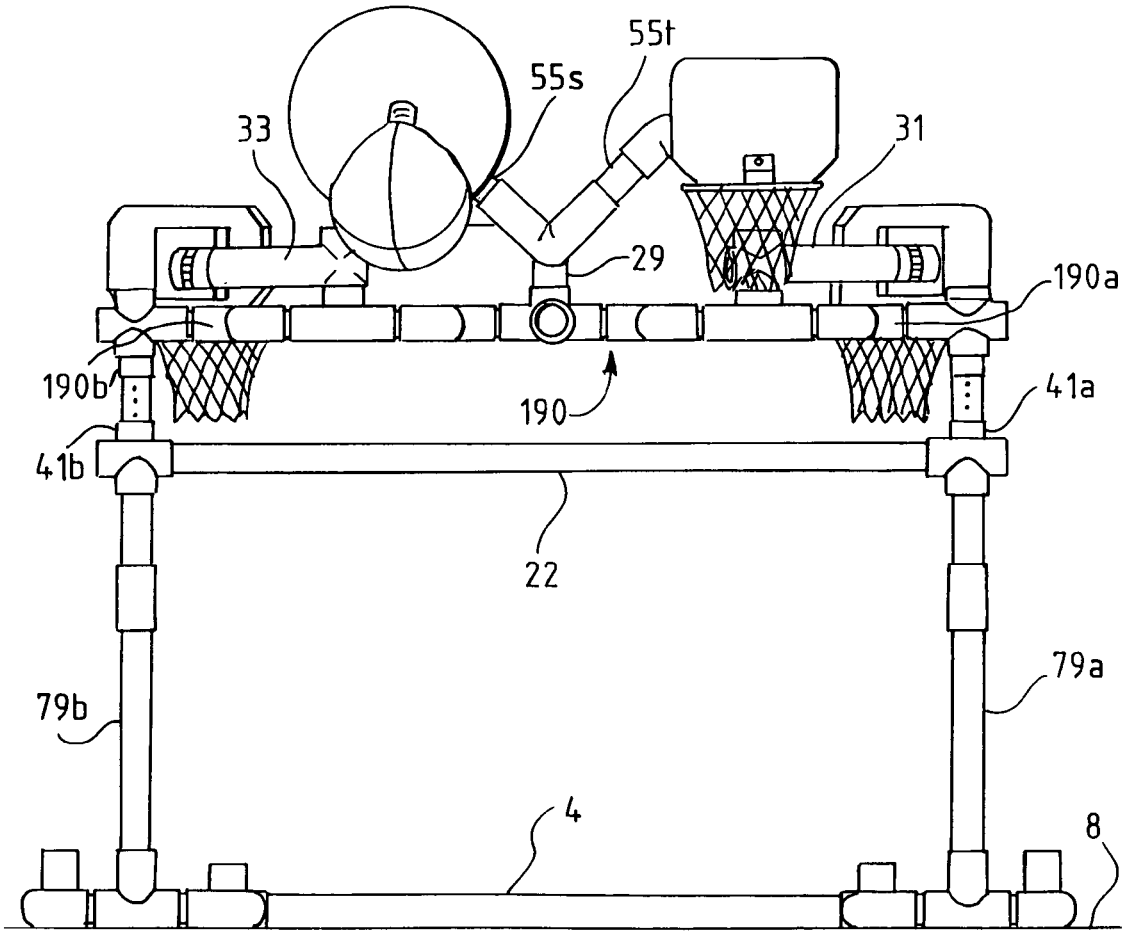
FIG. 5: Posterior view of modified AB Challenger.
Figure 6:
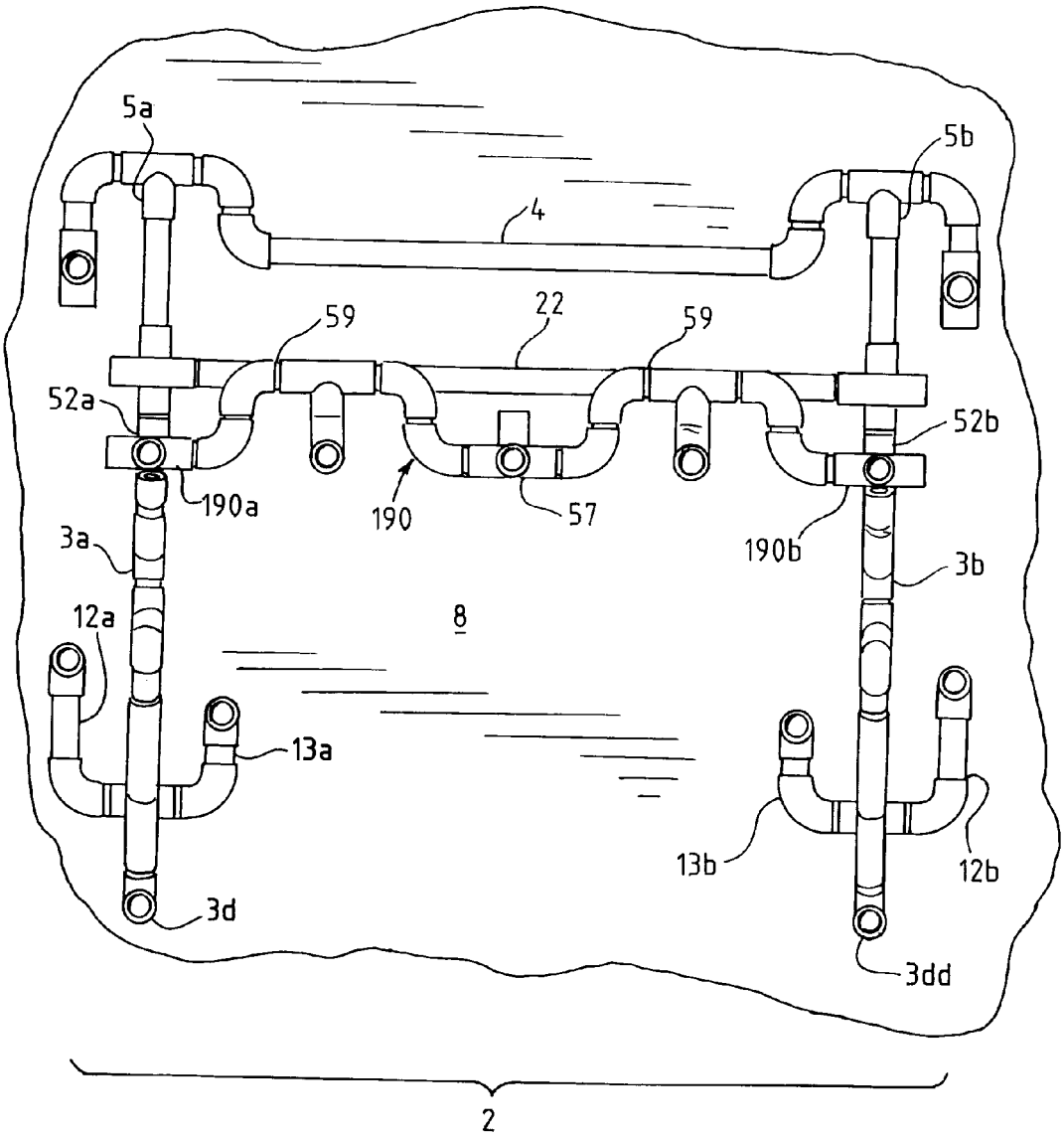
FIG. 6: Top plan view of modified AB Challenger without removable vertical components.
Figures 11, 12:
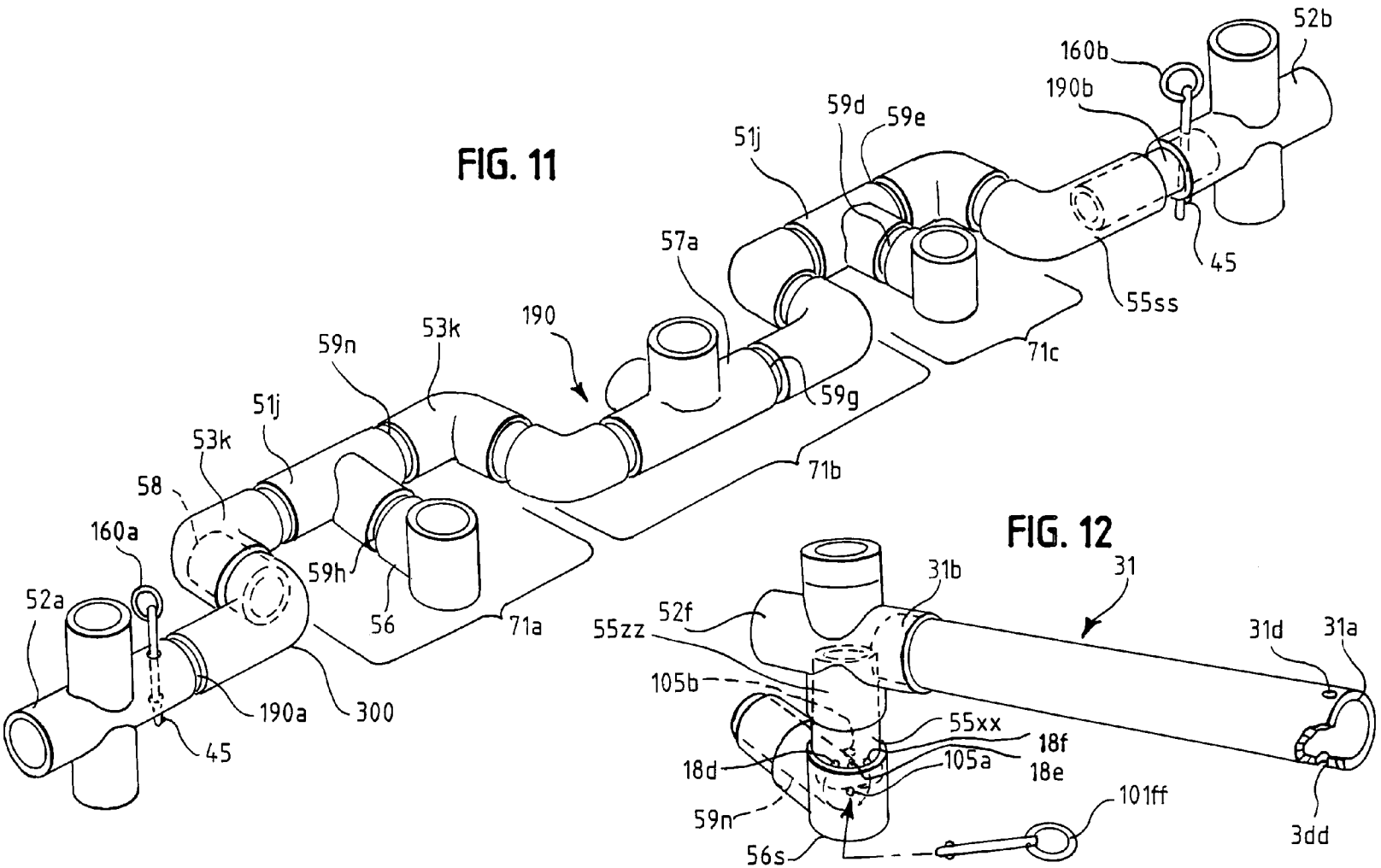
FIG. 11: Isolated close-up partial perspective view of rigid horizontal speedbag support bar.
FIG. 12: Isolated close-up partial perspective view of a lateral prong and swivel adjuster bar.

Referring now to FIGS. 5, 6 and 11, between first and second four-member cross connectors 52*a*, 52*b* lies horizontal speedbag support bar 190. Horizontal speedbag support bar 190 is parallel to rigid horizontal supporting surface 8, vertically positioned above base 2, and preferably perpendicular to base 2.

Horizontal speedbag support bar 190 is attached to each vertical speedbag adjuster bar 60,61 respectively by four-member cross connectors 52*a*, 52*b*, at first and second horizontal ends 190*a*, 190*b* respectively.

Referring now to FIG. 11, horizontal speedbag support bar 190 is preferably approximately 29 inches in length. Horizontal speedbag support bar 190 preferably comprises short alternating enclosed pipe segments 59*n*, 59*g* and 59*e*. Pipe segments 59*d*, 59*g*, 59*e* form first, second and third partial rectangular kinks 71*a*, 71*b*, 71*c* respectively (generically kinks 71).

In the preferred embodiment each lateral partial rectangular kink 71*a*, 71*c* comprises a kink pipe segment 58 within a kink t-joint connector 51*j*, as well as adjoining angled connectors 53*k*. Instead of a kink t-joint connector 51*j*, kink 71*b* comprises a central four-opening oblique angled connector 57*a*. Other configurations of speedbag horizontal support bar 190 are also within the scope of my apparatus 11. Short segments 55*ss* lie enclosed within side 300 of each kink 71*a*, 71*c*.

Still referring to FIG. 11, a first horizontal bar rounded detente pin 160*a* and a second horizontal bar detente rounded pin 160*b*, completely penetrate each four-member cross connector 52*a*, 52*b* respectively. Enclosed pipe segment 55*ss* also forms each end 190*a*, 190*b* of horizontal speedbag support bar 190.

As best seen in FIG. 11, each horizontal bar rounded detente pin 160*a*, 160*b* is oriented vertically to, and is perpendicular to, rigid horizontal support surface 8. First horizontal bar rounded detente pin 160*a* and second horizontal bar rounded detente pin 160*b* also penetrate each end 190*a*, 190*b* respectively of horizontal speedbag support bar 190. By mechanically engaging each four member cross connector 52*a*, 52*b* and horizontal speedbag support bar 190, pins 160*a*, 160*b* resist downward forces upon horizontal speedbag support bar 190.

Speedbag Vertical Height Adjuster Bars 60,61

Figure 10A:
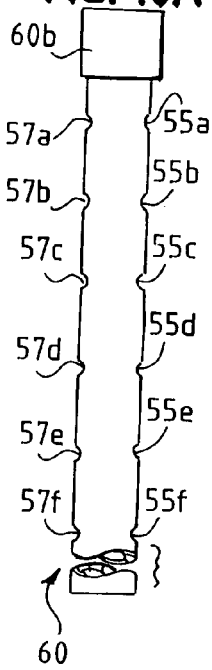
FIG. 10A: Close-up isolated lateral view of vertical speedbag adjuster bar with opposing aligned pinholes.

Referring now to FIGS. 10 and 10A, each rigid vertical upwardly protruding speedbag support bar 41*a*, 41*b* comprises one first and second speedbag vertical height adjuster bar 60, 61 respectively. Speedbag vertical height adjuster bars 60,61 change the vertical height of speedbags 201, 202, 203, basketball hoops 21*a*, 21*b*, 21*c* or other attachments as explained infra. Although only speedbag vertical height adjuster bar 60 is shown in FIG. 10, the structure and function of second speedbag adjuster bar 61 is exactly the same, and analogous reference numerals, such as 61, 41*b*, 101*g*, etc., designate identical structures and positions of structures.

Referring now to FIG. 10A, within each adjuster bar 60, 61 are two linearly aligned pinholes sets 55, 57 and 56, 58 respectively. For example, pinhole sets 55*a*, 55*b*, 55*c*, 55*d*, etc. and 57*a*, 57*b*, 57*c*, etc. comprises generic sets 55, 57 along adjuster bar 60.

The same is true for pinhole sets 56, 58 along adjuster bar 61. Linearly aligned pinholes within each set 55, 57 and 56, 58 are preferably approximately ¼(one-fourth) inch apart from each adjoining pinhole, for example within aligned set 55.

Linearly aligned pinhole sets 55, 57 on adjuster bar 60 and pinhole sets 56,58 on vertical height adjuster bar 61, preferably oppose each other at approximately 180 degrees. Each pinhole set 55, 57, 56, 58 preferably contains from fifteen to twenty pinholes, but more or fewer corresponding pinholes within pinhole sets 55, 56, 57 and 58 are also satisfactory. As described, supra, upper ends 60*b*, 61*b* of vertical speedbag height adjuster bars 60, 61 respectively, are permanently adhered, and engaged with a rounded detente metal pin 101*a*, 101*b* respectively, within each corresponding four member cross connector 52*a*, 52*b* respectively.

Referring now to FIG. 10, each vertical speedbag adjuster bar 60, 61 slidably and reversibly inserts into upper ends 42*c*, 42*d* of hollow vertical speedbag support bars 41*a*, 41*b* respectively. The user manually adjusts each vertical height adjuster bar 60,61 to obtain a different vertical height of horizontal speedbag support bar 190.

To alter the vertical height, the user raises or lowers attached horizontal speedbag support bar 190 the same number of linearly aligned pinholes along each speedbag support bar 60, 61.

For example, as best illustrated in FIGS. 10 and 10A, the user:

(1) Lifts each vertical speedbag adjuster bar 60, 61 from its respective upwardly rigid protruding speedball support bars 41*a*, 41*b*, (2) Until two corresponding pinholes 55*c*, 57*c*, 56*c*, 58*c* from each adjuster bar 60,61 appear just above upper circular edges 42*c*, 42*d*.

The user then inserts one rounded long metal detente pin 101*a*, 101*b* (generically pins 101) through sets of pinholes 55, 57 and 56, 58 respectively. Long rounded metal detente pins 101*a*, 101*b* retain each vertical speedbag adjuster bar 60, 61 at this new vertical height as backstops upon upper circular edges 41*c*, 41*d*. In this manner, one long rounded metal détente pin 101*a*, 101*b* on each side of horizontal speedbag support bar 190 sufficiently supports horizontal speedbag support bar 190 and other attachments, as well as the user's weight.

In the alternative, paired support bar apertures 400*a*, 400*b* on each vertical bar 41*a*, 41*b* can be inserted with pin 101 and aligned apertures within each adjustor bar 64,65 respectively which are congruent with support bar apertures 400*a*, 400*b* (not shown in FIGS. 9, 9A).

One pair of support bar apertures 400*a*, 400*b* are located within the upper edges of each upwardly protruding speedbag support pipe bar 41*a*, 41*b*. Support bar apertures 400*a*, 400*b* oppose each other in each upwardly protruding speedbag support pipe 41*a*, 41*b* at approximately 180 degrees in the preferred embodiment.

Common Stem 29 and Lateral Prongs 31, 32, 33

Common Stem 29

Referring now to FIGS. 2 and 13A, in the preferred embodiment horizontal speedbag support bar 190 lies directly beneath and perpendicular to a common stem 29. Support bar 190 connects to common stem 29 by common stem t-joint connector 51*w* and an opposing horizontal support t-joint connector 55*x*. Connectors 55*x*, 51*w* are rigidly attached to each other by short enclosed adhered pipe segment 55*z*.

Common stem 29 extends posteriorly to and then within, a first oblique angled connector 58*b*. First oblique angled connector contains first and second permanently adhered slanted short pipe segments 55*s*, 55*t* respectively within first and second pipe openings 44*a*, 44*b*.

As seen in FIG. 13A, each pipe segment 55*s*, 55*t* inserts reversibly within a speedbag attachment structure 66*a*, modified wider basketball hoop attachment 66*b* structure, or a conventional basketball hoop attachment 66*d* structure, infra. The purpose of these insertions is temporary storage of the interchangeable attachments.

First oblique angled connector 58*b* is optional in most embodiments. FIG. 13A. However, in the preferred embodiment oblique four opening angled connector 58*b* provides temporary placement of speedbag and basketball rim attachment structures in combination with pipe segments 55*s*, 55*t*. Common stem 29 preferably contains a second enclosed pipe segment 29*aa*. Segment 29*aa* diminishes the inner diameter of common stem 29, and lies within pipe segment 58*b*.

Lateral Prongs 31,33

Referring now to FIGS. 2 and 12, in the preferred embodiment a first lateral prong 31 and a second lateral prong 33 protrude anterior to horizontal speedbag support bar 190. The user manually connects each lateral prong 31,33 to support bar 190, by its respective vertical four member cross-connector 52*f*, 52*g* at each posterior lateral prong end 31*b*, 33*b* respectively.

Although FIG. 12 only illustrates one prong, each first and second lateral prong 31, 33 is structurally identical to the other. Therefore, each additional paired reference numeral designates the corresponding structure on the unseen lateral prong, i.e., 52*f*, 52*g*; 55*x*, 55*y*; 56*s*, 56*t*, etc. Each lateral prong 31, 33 is approximately fourteen inches long in the preferred embodiment, but other lengths are satisfactory in other embodiments.

Still referring to FIG. 12, each first and second vertical four member cross-connector 52*f*, 52*g* respectively contains a permanently adhered first or second vertical swivel adjuster bar 55*xx*, 55*yy* respectively. Swivel adjuster bars 55×, 55*y* each comprise a single short pipe segment 55*zz*. Each vertical swivel adjuster bar 55*xx*, 55*yy* reversibly inserts within a fifth or sixth vertical coffee cup connector 56*s*, 56*t* respectively.

A first enclosed and a second enclosed short horizontal pipe segment 59*n*, 59*o* respectively each connects vertical coffee cup connector 56*s*, 56*t* respectively to the corresponding t-joint connector 51*j* of each kink 71*a*, 71*c* respectively.

Still referring to FIG. 12, each lateral prong 31, 33 also has a first and second proximal circular edge 31*a*, 33*b* and a first and second distal end 31*b*, 33*b* respectively. Each proximal circular edge 31*a*, 33*a* can reversibly connect to speedball and basketball rim attachments structures infra. Each distal end 31*b*, 33*b* is preferably permanently adhered within four member cross connectors 52*f*, 52*g* respectively.

Each proximal circular edge 31*a*, 33*a* comprises a pair of opposing prong apertures 31*d*, 31*dd*, or 33*d*, 33*dd* respectively. Each pair of apertures 31*d*, 31*dd* and 33*d*, 33*dd* are approximately 180 degrees apart along the respective circular edge 31*a*, 33*a* respectively.

Swivel Adjuster Bars 55*x*, 55*y* for Lateral Prongs 31,33

Still referring to FIG. 12, each first and second vertical swivel adjustment bar 55*xx*, 55*yy* respectively, removably and vertically inserts into its respective vertical coffee cup connector 56*s*, 56*t*. Each swivel adjuster bar 55*xx*, 55*yy* respectively also swivels (rotates) within its coffee cup connector 56*s*, 56*t* respectively. Each swivel adjuster bar 55*xx*, 55*yy* is preferably cylindrical in shape.

Still referring to FIG. 12, each swivel adjuster bar 55*xx*, 55*yy* preferably comprises three anterior linear horizontal rotational pinholes, 18*d*, 18*e*, 18*f*; and three posterior linear horizontal rotational pinholes 18*dd*, 18*ee*, 18*ff* (not seen) (generically anterior linear horizontal rotational pinholes 18). Each linear horizontally aligned rotational pinhole 18 is approximately ⅛(one-eighth) inch from each adjacent pinhole 18 within its own set of three linear horizontal rotational pinholes 18. Anterior horizontally aligned rotational pinholes 18 are positioned approximately halfway along the vertical length of each vertical swivel adjuster bar 55*xx* or 55*yy*.

Still referring to FIG. 12, each vertical coffee cup connector 56*s*, 56*t* comprises an anterior aperture 105*a* and an opposing posterior aperture 105*b* respectively within each first and second coffee cup connector 56*s*, 56*t* respectively. Each anterior positioned aperture 105*a* congruently aligns with one swivel pinhole 18*d*, 18*e* or 18*f*, whenever swivel adjuster bar 55*xx*, 55*yy* swivels within its respective coffee cup connector 56*s*, 56*t*. Similarly, posterior aligned aperture 105*b* can congruently align with one swivel pinhole 18*dd*, 18*ee*, 18*ff* (not seen).

For example, the user manually swivels rotates each swivel adjuster bar 55*xx*, 55*yy* so a long rounded swivel detente pin 101*ff* penetrates apertures 105*a*, 105*b* and the corresponding congruent posterior and anterior pinholes 18*f*, 18*ff*. Pin 101*ff* thereby holds prongs 31,33 at a new predetermined angle from rigid horizontal speed bag support bar 190. This swiveling mechanism for angle adjustment of either lateral prong 31,33 is the preferred embodiment. However, other rotational mechanisms are also within the scope of my device 11.

Central Prong 32/Anterior-Posterior Adjuster Bar 125

Referring again to FIG. 13A, central prong 32 removably inserts within anterior end 29*a* of common stem 29. In the preferred embodiment central prong 32 is also an anterior-posterior adjuster bar 125, and its anterior end 32*a* is permanently adhered within prong two-ended linear connector 54*e*.

Central prong 32/horizontal adjuster bar 125 is preferably approximately eleven inches in length. However, other lengths are appropriate in other embodiments. Each prong two-ended linear connector 54*e* comprises a first opposing connector aperture 108*a* and a second opposing connector aperture 108*b*. Opposing connector apertures 108*a*, 108*b* oppose each other along two-ended linear connector 54*e* at approximately 180 degrees.

Still referring to FIG. 13A, central prong 32/anterior-posterior adjuster bar 125 also comprises first and second rows of linearly aligned pinholes 28*a*, 28*b*, 28*c*, etc., and 27*a*, 27*b*, 27*c*, etc. respectively (generically pinholes 27, 28). Each row of linearly aligned pinholes 27, 28 are parallel to each other along the length of central prong 32/anterior-posterior adjuster bar 125. There are approximately 180 degrees between opposing rows of parallel pinholes 27, 28.

Still referring to FIG. 13A, within anterior circular edge 29*a* are first universal aperture 162*c* and second universal aperture 162*d* (not seen).

First and second universal apertures 162*c*, 162*d* respectively oppose each other at approximately 180 degrees apart along stem anterior end 29*a*. Universal apertures 162*c*, 162*d* congruently align with specific corresponding pairs of opposing pinholes 27, 28, if the user rotationally superimposes them. The user can push or pull central prong 32/anterior-posterior adjuster bar 125 into or exteriorly from common stem 29.

As an example for adjusting the exposed length of central prong 32/anterior-posterior adjuster bar 125: the user manually inserts common stem long rounded pin 101*i* through congruent universal apertures 162*c*, 162*d* and pinholes 27*a*, 28*a*. Long rounded common stem pin 101*i* acts as a backstop for this preselected exposed length of central prong 32/anterior-posterior adjuster bar 125. Central prong 32/anterior-posterior adjuster bar 125 is necessary for use of modified basketball rim 150, described in detail infra.

Speedbags and Lateral Prong Speedball Attachment Structures 66*a*, 66*c*

Figure 16:
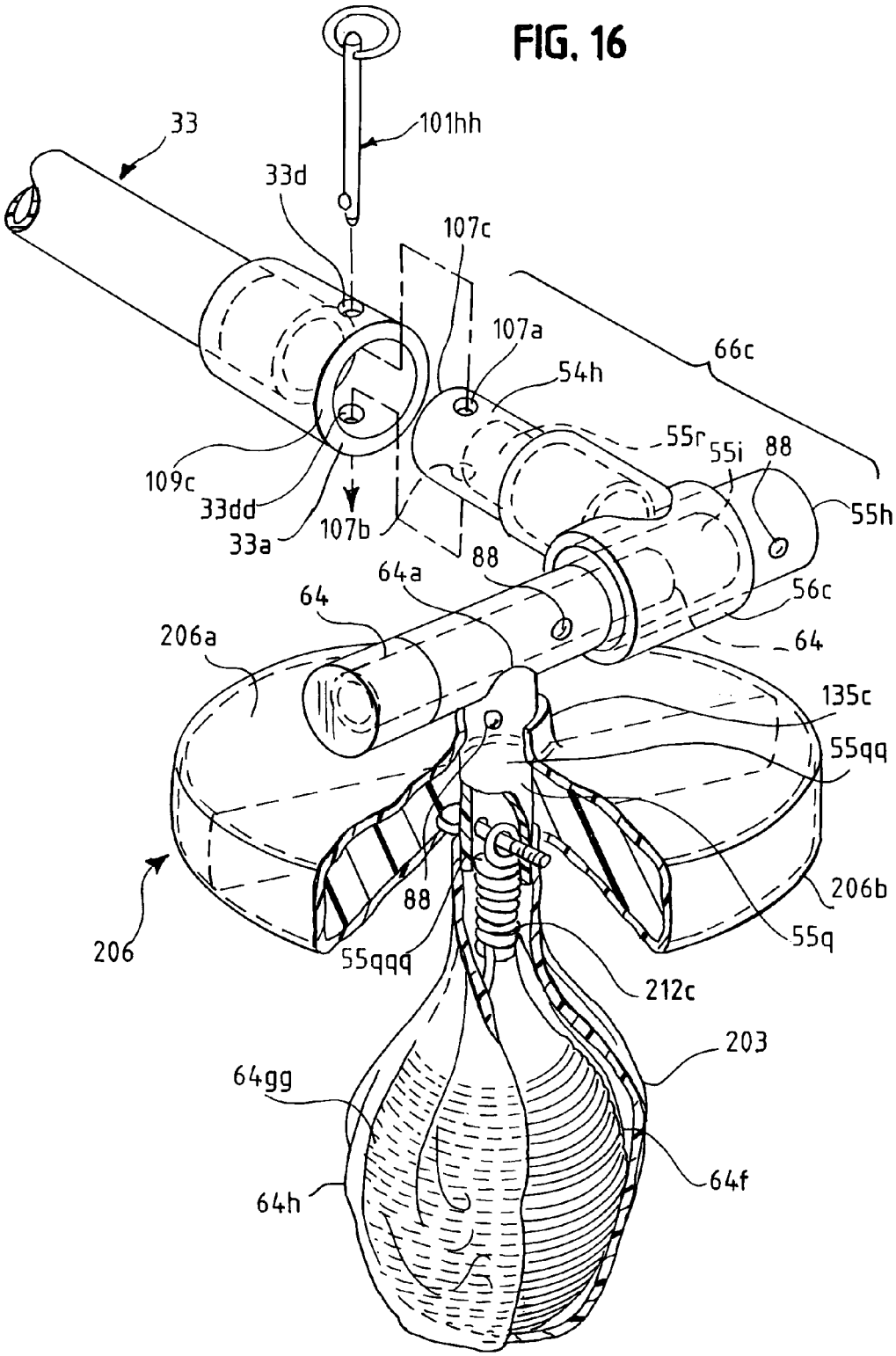
FIG. 16: Isolated close-up view of speedbag and speedbag attachment to a lateral prong.

Referring now to FIGS. 13B and 16, in the preferred embodiment each first and second lateral prong 31, 33 and common stem 29 attach to speedbags 201, 202, 203 (generically speedbags 200) by their corresponding first, second and third speedbag attachment structures 66*a*, 66*b*, 66*c* respectively (generically speedbag attachment structures 66). The preferred embodiment of my invention comprises all three speedbags 201, 202, 203 with corresponding attachment structures 66*a*, 66*b*, 66*c*.

Each lateral prong speedbag attachment structure 66*a*, 66*c* reversibly attaches to its corresponding lateral prong 31, 33 respectively as described in detail infra.

1. Lateral Prong Speedbag Attachment Structures 66*a*, 66*c*

FIG. 16 illustrates speedbag attachment structure 66*c* for lateral prong 33 in isolated partial anterior view. Speedbag attachment structures 66*a*, 66*c* are not interchangeable between lateral prongs 31, 33 because of spatial orientation. However, speedbag attachment structures 66*a*, 66*c* are identical in structure, operation and function, and so FIG. 16 is applicable to both speedbag attachment structures 66*a*, 66*c* and lateral prongs 31,33, as well as to analogous reference numerals.

For each lateral prong speedbag attachment structure 66*a*, 66*c*, a speedbag linear connector 54*h* and adjoining coffee cup connector 56*c* permanently enclose adhered short speedbag pipe segment 55*r*. Perpendicular to enclosed short pipe segment 55*r*, and also permanently adhered and riveted within coffee cup connector 56*c*, is perpendicular upper short pipe segment 55*h*.

Perpendicular short pipe segment 55*h* contains permanently adhered pipe segment 55*ii*, which in turn encloses smaller diameter closed end pipe segment 64. Each smaller diameter closed end pipe segment 64 comprises a downward protruding integral tubular protrusion 64*a*. Pipe segments 55*ii* and 64 are adhered and attached to each other with rivets 88.

Immediately positioned above each first and second lateral speedbag 201, 203 respectively, is first and second lateral cylindrical speedbag disc 204, 206 respectively. Second lateral speedbag 203 is attached to speedbag attachment structure 66*c*, and comprises corresponding disc 206. Still referring to FIG. 16, each respective integral tubular protrusion 64*a* penetrates its corresponding speedball disc 204 or 206 as the case may be.

Each flat speedbag disc 204, 206 comprises a top surface 204*a*, 206*a* respectively and a lower flat surface 204*b*, 206*b* respectively. Each flat speedbag disc 204, 206 is preferably made of rigid styrofoam, but other materials such as foam rubber are acceptable in other embodiments. Each lateral speedbag 201 is structurally identical to lateral speedbag 203, and flat speedbag disc 204 is structurally and functionally identically to disc 206. As a result, FIG. 16 accurately represents the structure of both lateral speedbags and their respective attachments by corresponding reference numerals.

Still referring to FIG. 16, a short disc pipe segment 55*q* inserts through respective first and second round aperture 135*a*, 135*c* within each disc 204, 206 center respectively. Each short segment 55*q* also inserts at its respective upper end 55*qq* within each respective tubular protrusion 64*a*. Each disc pipe segment 55*q* further comprises a first or second speedbag spring 212*a* or 212*c* respectively at its respective lower end 55*qqq*. Spring 212*a*, 212*c* moves in a limited manner.

Each speedbag spring 212*a*, 212*c* attaches to a corresponding first and second ovoid rigid plastic core 64*e*, 64*f* respectively within each corresponding larger plastic speedbag wrapping 64*g*, 64*h* respectively. Each large plastic speedbag wrapping 64*g*, 64*h* also comprises conventional off the shelf cotton batting (not seen in this view). Electrical tape (not seen) covers each flat speedbag disc 204,206 as well as tubular protrusion 64*a* and short disc pipe segment 55*q*. The preferred electrical tape is available from:

Gam Pack Products Corporation
475 Blay Street
Hillside, N.J. 07205

Gam Pack tape is seven-millimeter premium grade all weather electrical tape, which is approximately ¾ inch wide, seven thousandths of an inch thick, and 66 feet long. Speedbags 201, 203, as well as central speedbag 202 for the central position of common stem 29 infra, with pre-attached flat circular discs are available from:

JoAnn Fabrics & Crafts
555 Town Line Road
Vernon Hills, Ill.
847-362-1620

The preferred discs are approximately seven inches in diameter and approximately ⅜ inch in thickness.

2. Reversible Pin Connection of Lateral Prong Speedbag Attachments 66*a*, 66*c* to Lateral Prongs 31,33

Still referring to FIG. 16, each first and third speedbag 201, 203 reversibly attach to corresponding proximal ends 31*a*, 33*a* respectively, of each lateral prong 31,33 respectively by its corresponding speedbag attachment structure 66*a*, 66*c* respectively.

Still referring to FIG. 16, linear connector 54*h* of each speedbag attachment structure 66*a*, 66*b* comprises a first linear connector aperture 107*a* and second linear connector aperture 107*b* within pipe circular edge 107*c*. First and second opposing apertures 31*d*, 3*ldd*, 33*d*, 33*dd* are located in circular edge 109*c* of each lateral prong 31,33 respectively.

Still referring to FIG. 16, to connect lateral speedbag attachments 66*a*, 66*c* respectively to each corresponding lateral prong 31, 33 respectively, the user manually aligns prong apertures 31*d*, 31*dd*, and/or 33*d*, 33*dd* respectively with apertures 107*a*, 107*b*. He then inserts a long rounded metal detente pin 101*h* or pin 101*hh* through all four apertures. In this manner each lateral prong speedbag attachment circular edge 107*c* fits over each lateral prong 31,33 and is mechanically held in place by pin 101*h*, 101*hh* respectively.

3. Central Speedbag 202 and Central Speedbag Pin Attachment Structure 66*b*

FIG. 13B illustrates attachment structure 66*b* for speedbag 202 at centrally located common stem 29 along rigid horizontal speed bag support bar 190 (not seen). Attachment 66*b* comprises long speedbag connecting bar 38. Long speedbag connecting bar 138 inserts within common stem 29 similarly to central prong 32/anterior-posterior adjuster bar 125. The user manually inserts a long rounded pin 1011 through:

(i) two corresponding pinholes of two opposing rows of linearly aligned pinholes 37*a*, 37*b*, 37*c*, 37*d*, etc., 39*a*, 39*b*, 39*c*, 39*d*, etc. (generically, linearly aligned pinholes 37,39) within connecting bar 38, and;

(ii) opposing apertures 162*b*, 162*c* within circular edge 29*a*.

The above two steps physically connect attachment structure 66*b* to common stem 29, (by congruently aligned pinholes, 27*a* 27*b*, for example), and stabilize speedbag 202 in anterior and posterior directions.

Still referring to FIG. 13B, central speedbag 202 attaches to central speedbag disc 205 by small coffee connector 56*kk*. Small coffee cup connector 56*kk* is riveted to a smaller enclosed pipe segment 55*qq* protruding from long connecting pipe 38. Speedbag 202 and disc 205 are also covered with electric tape as described supra (not seen).

Small coffee cup connector 51*e* has a protrusion 64*aa* which attaches to spring 212*b* (not seen), as described supra for lateral speedbags 201, 203. Hollow speedbag connector bar 38 is approximately seventeen (17) in length in the preferred embodiment. However, other lengths of hollow speedbag connector bar 38 are also within the scope of my invention.

Conventional Basketball Rims 21

Figure 14B:
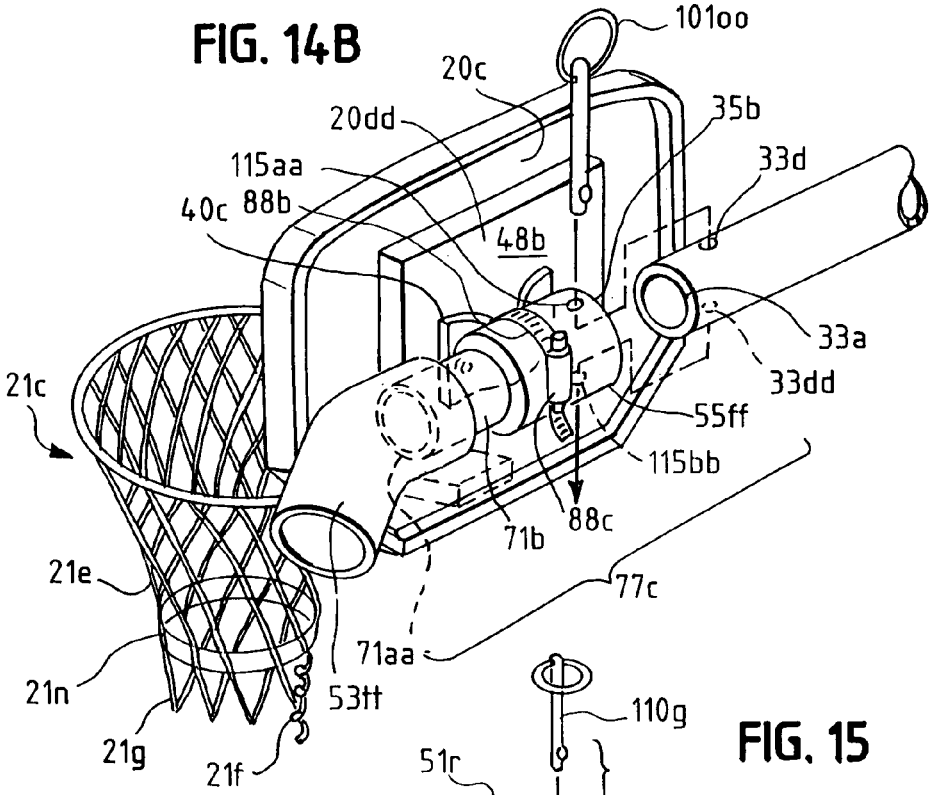
FIG. 14B: Isolated partial lateral view of lateral prong conventional basketball rim attachment structure.

Referring now to FIGS. 1, 14A and 14B, other embodiments of my invention comprise one or more conventional basketball rims 21*a*, 21*b*, 21*c* (generically conventional basketball rims 21). Conventional first and second lateral basketball rims 21*a*, 21*c* respectively reversibly attach to lateral prongs 31, 33 respectively by first and second lateral basketball rim attachment structures 77*a*, 77*c* respectively. Each first and second lateral conventional basketball rim attachment structure 77*a*, 77*c* respectively is adjustable horizontally, using swivel adjusters 55*x*, 55*y* described supra.

Lateral Conventional Basketball Rims 21*a*, 21*c* and Attachment Structures 77*a*, 77*c*

First and second lateral conventional basketball rim attachment structures 77*a*, 77*c* are not interchangeable between prongs 31, 33. FIG. 14B shows lateral basketball rim attachment structure 77*c* with lateral prong 33. However, in this embodiment first lateral attachment structure 77*a* is identical in structure and function to second lateral attachment structure 77*c*. With this particular embodiment, each basketball rim attachment structure 77*a*, 77*c* is oriented so that each attached basketball rim 21*a*, 21*c* is interior to, and more centrally positioned than, its corresponding lateral prong 31, 33. Please see FIG. 1. However, the components of lateral conventional basketball rim 21*a* and attachment structure 77*a* in FIG. 14B are structurally and functionally identical to those of lateral conventional basketball rim 21*c*. Therefore, corresponding reference numeral pairs such as 53*t*, 53*tt* and 55*f*, 55*ff*, designate corresponding structures.

Referring to FIG. 14B, each first and second conventional lateral basketball rim 21*a*, 21*c* respectively, as well as central conventional basketball rim 21*b* infra, comprises a spring 21*f* at the bottom 21*g* of each basketball net 21*e*. Spring 21*f* prevents a ball from bouncing from basketball net 21*e* and disrupting the user's exercise routine. Electric tape secures spring 21*f* to an elastic band 21*n*. Band 21*n* comprises hook and loop fastener material which is available from:

Velcro® U.S.A.
406 Brown Ave.
Manchester, N.H. 03103
Telephone: 1-800-225-0180
Fax: 1-800-835-2761

Spring 21*f* are available from:

Prime Line Products Company,
San Bemadin, Calif. 92407

The preferred springs 21*f* are this company's "handyman springs." These handyman springs are approximately ¼ inch in length, approximately one and ⅞ inches in width, and approximately ⅓ (one-third) inch in thickness.

Still referring to FIG. 14B, each first and second conventional basketball rim 21*a*, 21*c* attaches to first and second lateral basketball rim attachment structure 77*a*, 77*c* respectively by a corresponding first and second backboard 20*a*, 20*c* respectively. Each backboard 20*a*, 20*c* attaches to a first or second particleboard square 48*a* or 48*b* respectively at the posterior surface 20*d*, 20*dd* respectively of each corresponding backboard 20*a*, 20*c* respectively. Each particleboard square 48*a*, 48*b* is approximately ¾ inch in thickness. Each particular board square 48*a*, 48*b* attaches to backboard posterior surface 20*d*, 20*dd* by rivets and/or an adhesive such as P4 PVC cement (not seen).

Still referring to FIG. 14B, physically connecting each particleboard square 48*a*, 48*b* to first or second lateral basketball rim attachment structure 77*a*, 77*c* respectively is first or second attachment bracket 40*a*, 40*c* respectively. Each bracket 40*a*, 40*c* is attached by connecting screws 88*a* (not seen) to each corresponding particleboard 48*a*, 48*b*. Metal strip 88*b* loops under serrated metal ring with tightening screw 88*c*, and metal strip 88*b* encloses a corresponding short linear connector 55*f*, 55*ff*. Each corresponding short connector 55*f*, 55*ff* encloses first and second generically short bracket pipe segment 71*a*, 71*b* respectively. Bracket first and second angled connectors 53*t*, 53*tt* respectively are permanently adhered to terminal ends 71*a* or 71*aa* respectively of short bracket pipe segment 71*a*, 71*b* respectively.

Still referring to FIG. 14B, each short bracket linear connector 55*f*, 55*ff* comprises a first opposing lateral aperture 115*a*, 115*aa* and a second opposing lateral aperture 115*b*, 115*bb* in each respective short circular rim 35*a* or 35*b* respectively. To attach each lateral prong attachment structure 77*a*, 77*b*, each short linear connector 55*f*, 55*ff* slides over each respective lateral prong proximal end 31*a* or 33*a* respectively. A long rounded metal detente pin 101*o* or 101*oo* is then inserted through manually aligned apertures 115*a*, 115*b* or 115*aa*, 115*bb*, and opposing lateral apertures 31*d*, 3*ldd* or 33*d*, 33*dd* respectively.

Each lateral prong conventional basketball rim 21*a*, 21*c* is approximately sixty degrees from center basketball rim 21*b* infra in this particular embodiment. conventional lateral prong basketball rims 21*a*, 21*c* are also adjustable to more or less than a sixty-degree angle.

Conventional basketball rims 21*a*, 21*b*, 21*c*, with pre-attached backboards 20*a*, 20*c* and hinged hardware included, are available from:

Good Stuff Corporation
47-00 33rd St.
Long Island City, N.Y. 11101

Specifically recommended is the "Looney Tunes Basketball Set" with soft basketballs.

Central Conventional Basketball Rim 21*b* and Central Conventional Basketball Rim Attachment Structure 77*b*

Referring now to FIG. 14A, central conventional basketball rim 21*b* is structurally identical in all respects to lateral basketball rims 21*a*, 21*c*. However, its attachment structure 77*b* comprises hollow basketball rim central connecting pipe 169*c*, which resembles central prong 32/anterior-posterior adjuster bar 125. Each long connecting pipe 169*c* comprises a set of first and second opposing linearly aligned sets of pinholes 170, 171. Each linearly aligned set 170, 171 are approximately 180 degrees apart along hollow basketball rim connecting pipe 169*c*.

First linearly aligned set of pinholes 170 comprises individual pinholes 170*a*, 170*b*, 170*c*, etc, while second basketball rim pinhole set 171 comprises individual pinholes 171*a*, 171*b*, 171*c*, etc. For example: To connect central conventional basketball rim attachment structure 77*b* to common stem 29, a specific pair of opposing pinholes such as 170*b*, 171*b* are manually and congruently aligned with universal apertures 115*a*, 115*b* in stem edge 29*a*. Long rounded metal detente pin 101*q* is then inserted through pinholes 170*b*, 171*b* and apertures 115*a*, 115*b*, to mechanically hold connecting pipe 169*c* rigidly in place.

Central connecting pipe 169*c* is attached to a particleboard square 48 on the posterior backboard surface 20*bb* as seen in FIG. 14A. Particleboard square 48 is riveted and/or permanently adhered to the posterior backboard surface 20*bb*. Anterior connecting pipe end 169*d* is enclosed by a serrated metal ring 40 with a lock screw 40*a* (i.e., band clamp or hose clamp 40*b*). This serrated metal ring 40 encloses metal strips 88*e*. Metal strips 88*e* are riveted to a particle board 40 posterior surface and anterior connecting pipe end 169*d*. Electrical tape is recommended for further adhering metal strips 88*e* to the exterior of connecting pipe 169*c*. The anterior connecting pipe end 169*d* is perpendicular to and flush with particleboard square 48.

Modified Wider Basketball Rim 150 and Attachment Structure Wider Basketball Rim 150

Figure 15:
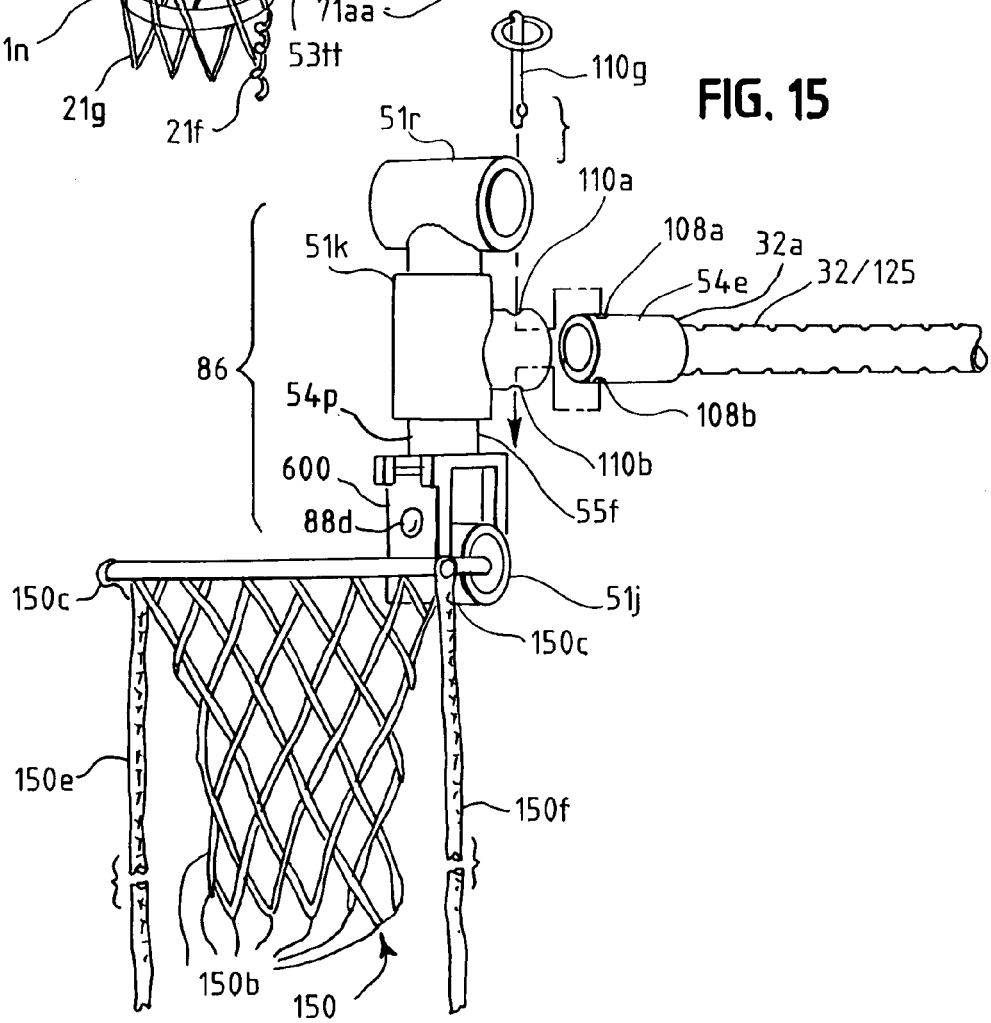
FIG. 15: Isolated posterior view of wider modified basketball rim with central prong/anterior-posterior adjuster bar attachment structure.

My improved exercise apparatus 11 comprises an attachable modified wider basketball rim 150 in other embodiments. Referring now to FIG. 15, modified wider basketball rim 150 comprises a wider hoop diameter than conventional basketball hoops 21*a*, 21*b*, 21*c*. Modified wider basketball rim 150 also comprises a modified net 150*b* without a spring.

Along circumference 150*c* of modified wider basketball rim 150 are first and second braided flexible cords 150*e*, 150*f* respectively. Each flexible braided cord 150*e*, 150*f* opposes the other along modified wider basketball hoop 150 at approximately 180 degrees.

Each braided flexible cord 150*e*, 150*f* is approximately 52 inches in length. Modified wider basketball rim 150 is available in plastic from:

Toys "R" Us
1610 Deerfield Road
Deerfield, Ill.
Phone: 847-831-5500

Again referring to FIG. 15, modified wide basketball rim 150 comprises hingelike member 600. Hingelike member 600 allows limited vertical movement of modified wider basketball rim 150. Hingelike member 600 partially encloses modified hoop t-joint connector 51*j*, and member 600 attaches to connector 51*j* with screws and/or rivets 88*d*.

Modified rim t-joint connector 51*j* is partially covered with electrical tape (not seen), and connector 51*j* attaches by rivets or screws 88*d* to intermediate length pipe segment 55*f* (not seen). Pipe segment 55*f* is permanently enclosed within modified linear two-end connector 54*p* and encircling rotating vertical parallel t-joint connector 51*k*. Uppermost vertical t-joint connector 51*r* permanently adheres to and encloses uppermost end of intermediate length pipe segment 55*f*.

2. Modified Wider Basketball Rim Pin Attachment Structure 86

Still referring to FIG. 15, attached to the anterior end 32*a* of central prong 32/anterior-posterior adjuster bar 125 is permanently adhered central prong two-ended linear connector 54*e*. Central prong two-ended linear connector 54*e* comprises first opposing connector aperture 108*a* and second opposing connector aperture 108*b* at approximately 180 degrees to each other. Opposing connector apertures 180*a*, 180*b* are vertically aligned with respect to a flat horizontal supporting surface 8 (not seen in FIG. 15).

Still referring to FIG. 15, encircling rotating parallel vertical t-joint connector 51*k* comprises first modified pin aperture 110*a* and second modified pin aperture 110*b*. Apertures 110*a*, 110*b* oppose each other at approximately 180 degrees, and are vertically aligned to each other with respect to a flat horizontal supporting surface 8. To attach modified basketball rim 150 to central prong 32/anterior-posterior adjuster bar 125, the user manually slides encircling rotating parallel t-joint connector 51*k* over two-end linear connector 54*e*. When properly aligned, basketball rim 150 should face outwardly towards the anterior of device 11.

The user then aligns apertures 110*a*, 110*b*, with apertures 108*a*, 108*b*, and inserts rounded long detente pin 101*g* through all four apertures. Pin 101*g* mechanically retains modified wider basketball rim 150 and attachment structure 86 to central prong 32/anterior-posterior adjuster bar 125.

Long Rounded Pins (Generically Long Rounded Pins 101)

As best seen in FIG. 13A as pin 101*i*, generically each long rounded detente pin 101 comprises a small spring-based protuberance, or small detente tab 45, at the distal end of each pin 101. Each small detente tab 45 provides mechanical retention of long rounded pin 101 in an inserted position. Long rounded pins 101 are made of sufficient strength metal and are available from:

Crown Bolt, Inc.
Corritos, Calif. 90703 in two types:

(a) eye-bolt, 5/16 inch diameter×four inch length; and
(b) hitch pin, cotterless: 1/3" diameter×1 and 3/4 inch length and 1/4 inch diameter×three inch length.

Hitch pins, of 1/4-inch diameter×three-inch length, are preferred for my modified exercise apparatus 11. These particular metal pins 101 are sufficiently strong to withstand a person's weight, as well as the weight of apparatus 11.

Double Vertical Basketball Rim 300 and Attachment 305

Figure 20:
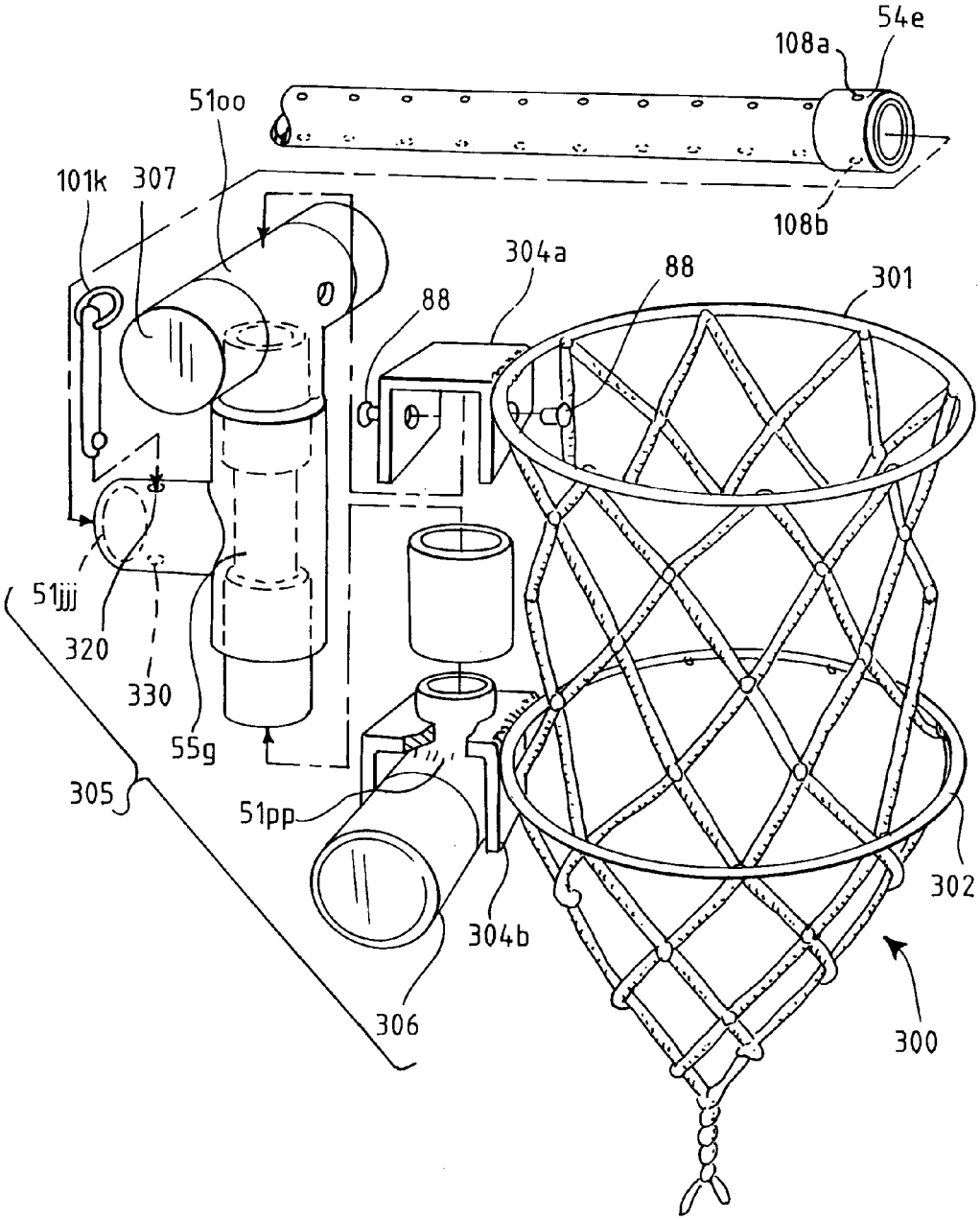
FIG. 20: Anterior isolated view of double basketball rim with attachment structure.

Referring now to FIG. 20, other embodiments comprise at least one double vertical basketball rim 300 with accompanying double rim attachment structure 305. In this embodiment, first and second conventional basketball rims 301, 302 respectively connect to double rim attachment structure 305 by first and second plastic enclosing brackets 304*a*, 304*b* respectively. Using rivets 88, enclosing plastic brackets 304*a*, 304*b* each partially enclose a first short closed end pipe 306 and a second short closed end pipe 307 respectively.

Still referring to FIG. 20, each short closed end pipe 306, 307 comprises an upper and lower central t-joint connector 51*oo*, 51*pp* respectively. An intermediate length double rim pipe segment 55*g* inserts into upper central t-joint connector 51*oo*, and lower central t-joint connector 51*pp*, and is permanently enclosed therein. Optionally there is also a moveable linear segment 55*mm* (not seen) which slides along pipe rim segment 55*g*(not seen). Linear segment 55 mm provides a backstop for t-joint connector 51*jjj*, infra.

Still referring to FIG. 20, an attachment moveable t-joint connector 51*jjj* comprises a first attachment aperture 320 and a second attachment aperture 330. Apertures 320, 330 oppose each other at approximately 180 degrees along t-joint connector 51*jjj*. T-joint connector 51*jjj* slides over and encloses linear connector 54*e*. Apertures 320, 330 congruently align with apertures 180*a*, 108*b* within linear connector 54*e* to attach to double basketball rim round metal detente pin 101*k*.

Double basketball rim 300 allows a choice of basketball rims at two different vertical heights simultaneously and during the same exercise routine. In this manner, the user need not halt the routine to change rims. In addition, double basketball rim 300 is much wider in diameter than the other rims 201,202,203. Consequently, the corresponding basketball can be larger and heavier, and requires that the user apply two hands instead of just one.

Double basketball rim 300 is applicable to other exercises with the smaller attachable basketball rims 201, 202, 203 described supra.

Use of Modified AB Challenger Exercise Apparatus

1. Speedbag Exercise

The first exercise for the preferred embodiment strengthens abdominal muscles. The user initially reclines upon a mat facing attached speedbags 201, 202, 203. The user next raises his upper body and punches one of lateral speedbags 201 or 203 at least one time. He then immediately strikes central speedbag 202 two times prior to reclining again.

The user then repeats the same movement with a second, and then a third attached speedbag. Ideally, the user punches the central, left lateral, central, and then right laterally positioned speedbag 201, 202, 203 respectively, in sequence. The user gradually increases the number and speed of complete sequential punching movements, as he or she progressively strengthens abdominal muscles. Use of three conventional basketball rims 21 in sequence and using similar movements, is also possible in other embodiments.

In a second exercise, the user initially reclines upon a mat facing basketball rims 21*a*, 21*b*, 21*c*. The user raises the upper body and places a ball into center basketball rim 21*b*. The user then reclines upon the mat while extending both arms to pull the ball from the bottom of basketball net 21*g*. The user repeats this exercise with left lateral basketball rim rim 21*c*, returns to center basketball rim 21*b*, and then repeats this exercise with right lateral basketball rim 21*a*.

With a third exercise, the user reclines upon the mat facing conventional basketball rims 21*a*, 21*b*, 21*c* and with feet placed upon horizontal foot stand bar 22. The user raises the upper body while completing a figure eight motion with a ball between the legs. The user then places the ball into the center basketball rim 21*b* and again reclines upon the mat. The user then extends both arms to pull the ball from the bottom of basketball net 21*g*.

The user repeats this third exercise with left lateral basket rim 21*c*, he returns to center basket 21*b*, and finally he repeats these same movements to right side basketball hoop 21*a*. This exercise is also appropriate for three speedbags 201, 202, 203: Instead of throwing and retrieving the ball, the user punches each lateral speedbag 201, 203 at least one time after completing a "figure eight" motion.

He then punches central speedbag 202 two times. He next repeats the entire sequence (figure eight motion and punching each lateral speedbag 201, 202) once on each lateral speedbag 201, 203, and then two times using central speedbag 202.

The user can also combine speedbags 201, 202, 203 and conventional basketball rims 21 when performing this third exercise, or the exercises described supra. Use of three conventional basketball rims 21*a*, 21*b*, 21*c* in sequence is also possible in another embodiments. Use of modified wider basketball rim 150 is limited to central prong 32/horizontal adjuster bar 125 (because of basketball rim attachment structure 86 and pin 101*g*, supra).

2. Modified Wider Basketball Rim 150—Sample Exercises

To use modified wider basketball rim 150, the person places his head upon horizontal footstand support bar 22 and underneath rigid horizontal speedbag support bar 190. Preferably, the person is lying on a mat on a rigid horizontal surface 8, with his feet pointing toward the anterior portion of the exercise device 11.

The user next places an appropriately sized ball between his feet and then brings the ball toward modified basketball rim 150. At this point, the user is also holding each braided cord 150*e*, 150*f* in each hand, while simultaneously grasping horizontal footstand support bar 22.

The user next drops the ball onto wider modified basketball rim 150. The user then takes the ball again between his feet, and brings his legs downwardly to the original starting position, and without dropping the ball. This exercise is particularly effective for the lower portion of the rectus abdominus stomach muscles.

To vary the above exercise, the user pulls braided cord 150*f* with his left hand to pull modified wider basketball rim 150 toward his left side. The user next brings the ball to modified wider basketball rim 150 with his feet, as described in the previous exercise. The user then brings the ball toward modified wider basketball rim 150 by angling toward his left side. The user then angles his feet holding the ball, toward modified wider basketball rim 150. At this point the user is still holding each cord 150*e*, 150*f* and grasping horizontal rigid footstand bar 22.

After the ball is placed upon modified wider basketball rim 150 toward the user's left side, the user then lowers his legs and feet with the ball to the original position. The user than pulls right braided cord 150*e* with his right hand, to bring modified wider basketball rim 150 to its original central position. This particular exercise is recommended for external and internal oblique muscles of the right stomach area.

In the next cycle of this exercise, the user again raises his feet and legs to grasp the ball from modified wider basketball rim 150. The user continues the exercise routine by next pulling right braided cord 150*f* toward his right side, while still grasping horizontal rigid footstand bar 22. The user brings the ball toward his right side and angles the ball with his feet toward modified wider basketball rim 150.

The user's legs and feet next return to the lower starting position while the ball rests upon modified wider basketball rim 150. This particular exercise is recommended for both external and internal oblique muscles of the left stomach area. No speedbags are required for this particular reverse abdominal exercise routine or two lateral variations.

Arm Grips

The user applies the pivoting armgrips 75*a*, 75*b* to support his or her weight. He also uses armgrips 75*a*, 75*b* to pull his torso anterior for additional abdominal exercises during reverse sit-ups. This use occurs whenever fatigue affects abdominal muscles before the remaining muscles are completely stretched or flexed. Armgrips 75*a*, 75*b* stabilize entire apparatus 100 whenever they are placed upon rigid horizontal surface 8 exterior to parallel base bars 3*a*, 3*b*.

Lower Slanted Framework 250 Combined With Modified AB Challenger Apparatus 11

Figure 17:
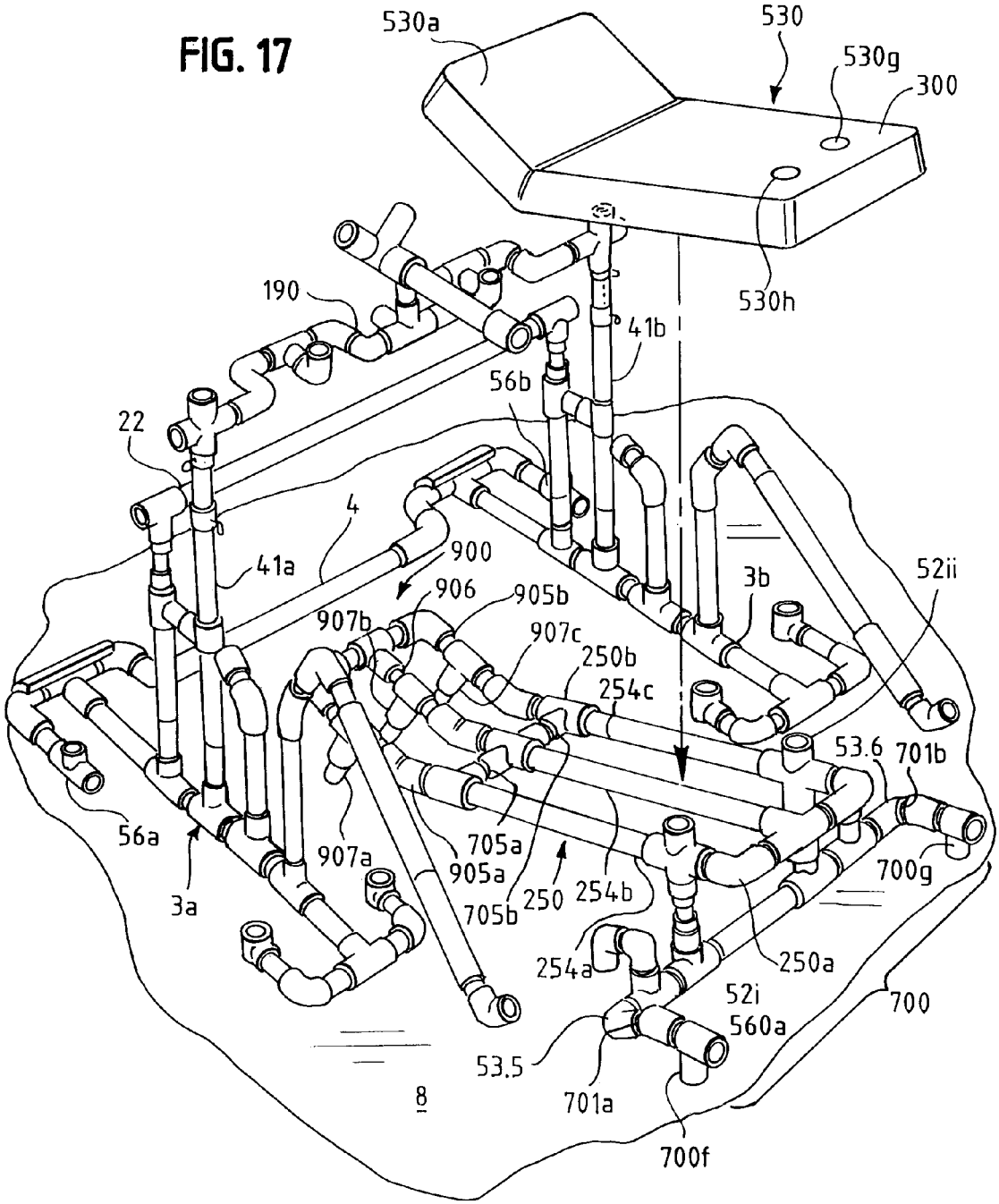
FIG. 17: Partial perspective view of modified AB Challenger with lower slanted framework and framework pad.

Referring now to FIG. 17, in this embodiment the user combines a lower slanted framework 250 with modified AB challenger exercise apparatus 11. Lower slanted framework 250 is also a component of my functional reclining multiuse exercise apparatus 100. Functional reclining multiuse exercise apparatus 100 is disclosed in U.S. continuation in part application Ser. No. 09/864,854, incorporated herein by reference.

Lower slanted framework 250 is approximately 55 inches in length and 19 inches in width at discontinuous base 700 infra. Lower slanted framework 250 has a first upper end 250*a* and a second lower end 250*b*. Framework 250 also comprises a first parallel longitudinal pipe 254*a*, a second longitudinal parallel pipe 254*b* and a third longitudinal parallel pipe 254*c*. Lower slanted framework 250 is preferably comprised of hollow polyvinylchloride (PVC) pipe.

Removable Framework Reclining Pad 530

Referring again to FIG. 17, lower slanted framework 250 comprises a removable framework reclining pad 530. Removable framework reclining pad 530 comprises a first round aperture 530*g* and a second round aperture 530*h* at pad upper end 300. Each round aperture 530*g*, 530*h* is approximately 2 and ½ to three inches in diameter. Each round aperture 530*g*, 530*h* fits over the corresponding uppermost opening of a four member cross connector 52*i*, 52*ii* upon lower slanted framework 250.

The length of my removable framework reclining pad 530 is approximately 34 inches, the width is approximately 14 inches, and its thickness is approximately two inches. Removable framework reclining pad 530 also comprises integral angled extension 530*a*. Integral angled extension 530*a* has the same width and thickness as reclining pad 530, but integral angled extension 520*a* is approximately ten and one-half inches in length. However, other numerical measurements of the dimensions of framework 250 and removable framework reclining pad 530 are also within the scope of my exercise apparatus 11.

Removable framework reclining pad 530 is comprised of approximately a one- (1) inch thickness of black leather covering and cotton batting. Plywood strips comprising the frame are approximately ¼ inch in width and approximately ¼ inch in thickness.

Removable framework reclining pad 530 is custom made by:

J. Upholstering
Fabrics & Furniture
4093 West Irving Park
Chicago, Ill.

Other satisfactory materials can be substituted in my pad 530 and includes polyester batting or an artificial leather cover.

Second Lower Attachment 900

Referring to FIG. 17, second lower attachment assembly 900 is attached to lower slanted support end 250*b* at perpendicular pipe segments 705*a*, 705*b*. Second lower attachment assembly 900 comprises first and second lateral pipe segments 905*a*, 905*b* respectively and a central pipe segment 906.

Each pipe segment 905*a*, 905*b*, 906 comprises a first, second and third small footlet 907*a*, 907*b*, 907*c* respectively (generically footlets 907), for support upon rigid horizontal surface 8. Pipe segments 905*a*, 905*b*, 906 are parallel to each other. The length of each lateral pipe segment 905*a*, 905*b* and central pipe segment 906 is approximately eleven inches. Each footlet 907 comprises a t-joint connector 51 into which a short pipe segment 55 is permanently inserted and adhered.

As seen in FIG. 17, the most anterior portion of lower attachment assembly 900 aligns with protruding coffee cup connectors 56*a*, 56*b* when using my combined exercise devices 11, 250.

Abbreviated Base 700

Figure 19A:
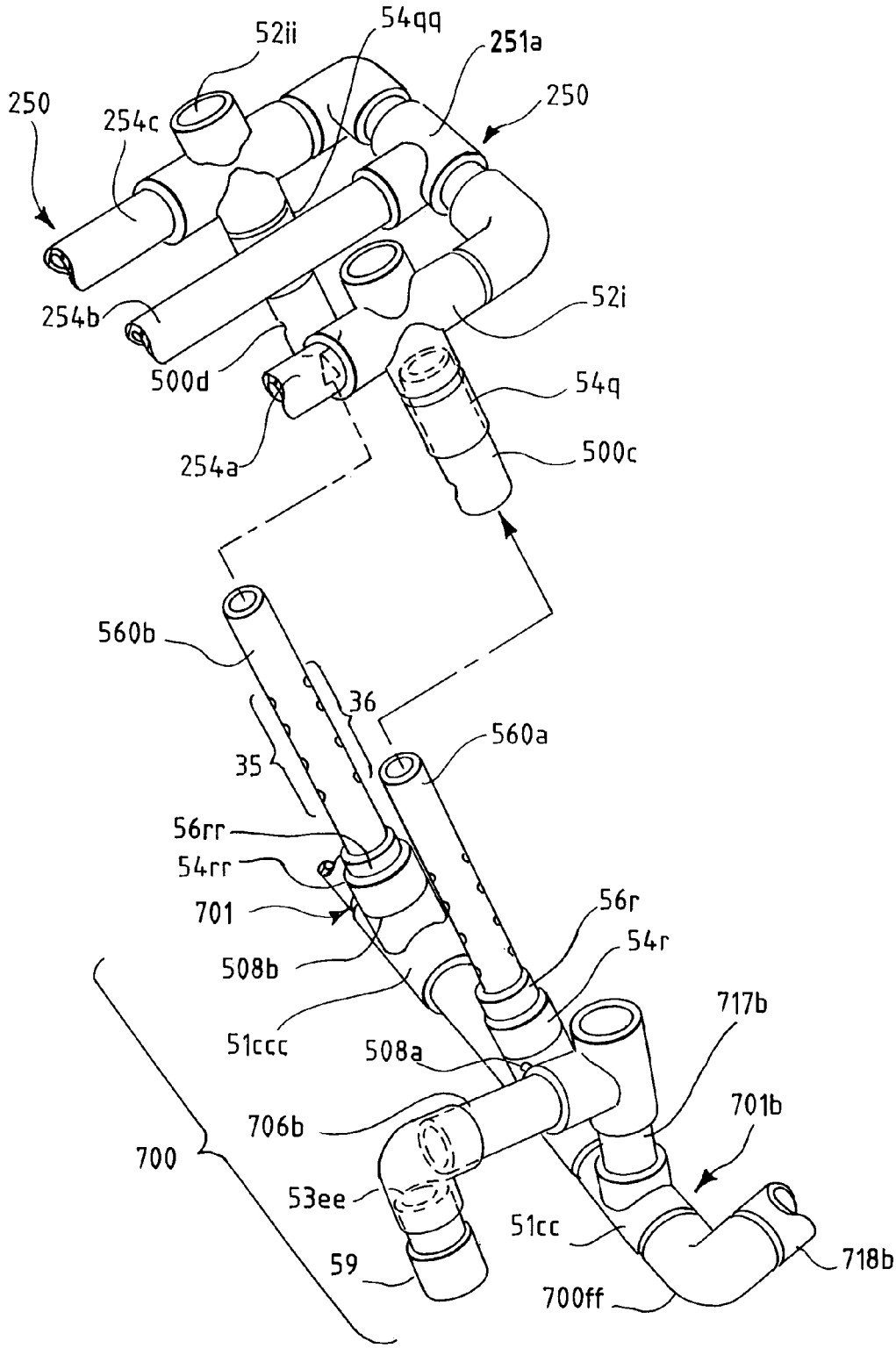
FIG. 19A: Isolated close-up view of slanted support pipes, lower slanted framework, and transverse connecting bar.

Referring now to FIGS. 17 and 19A, abbreviated base 700 minimally comprises transverse connecting bar 701. Transverse connecting bar 701 comprises a first transverse end 701*a* and a second transverse end 701*a*.

Lower slanted framework 250 is connected to, and partially supported by first and second parallel slanted support pipes 500*c*, 500*d* respectively, which slidably attach to transverse connecting bar 701, infra. The width of abbreviated base 700 is approximately 25 inches, but other widths are also acceptable.

Referring now to FIG. 19A, upper ends of pipes 500*c*, 500*d* are each permanently adhered within:

(i) a corresponding second linear connector 54*q*, 54*qq* and;

(ii) corresponding adjoining second four-member cross-connector 52*i*, 52*ii* along lower slanted framework 250.

Transverse connecting bar 701 also comprises first transverse footlike pipe segment extension 706*b* and second transverse footlike pipe segment extension 706*a* (not seen). First and second transverse footlike pipe segment extensions 706*a*, 706*b* stabilize discontinuous base 700 along rigid horizontal surface 8. Each transverse footlike pipe segment extension 706*a*, 706*b* is integrally attached to first and second upwardly reclining protruding arms 717*a*, 717*b* respectively.

Referring to FIGS. 17 and 19A, arms 717*a*, 717*b* permanently insert within t-joint connectors 51*cc* along transverse connecting bar 701. Extensions 706*a*, 706*b* each comprise one downwardly extended angled connector 53*ee*, as well as a single cap 59. Each end of transverse connecting bar 700 also comprises first and second supporting protruding footlet 700*f*, 700*g* along each first and second extending pipe 718*a*, 718*b*(not seen) respectively. Each extending pipe 718*a*, 718*b* permanently inserts into first and second adjoining angled reclining connectors 53.5,53.6 respectively.

Long Angled Adjuster Bars 560*a*, 560*b*

Figure 19B:
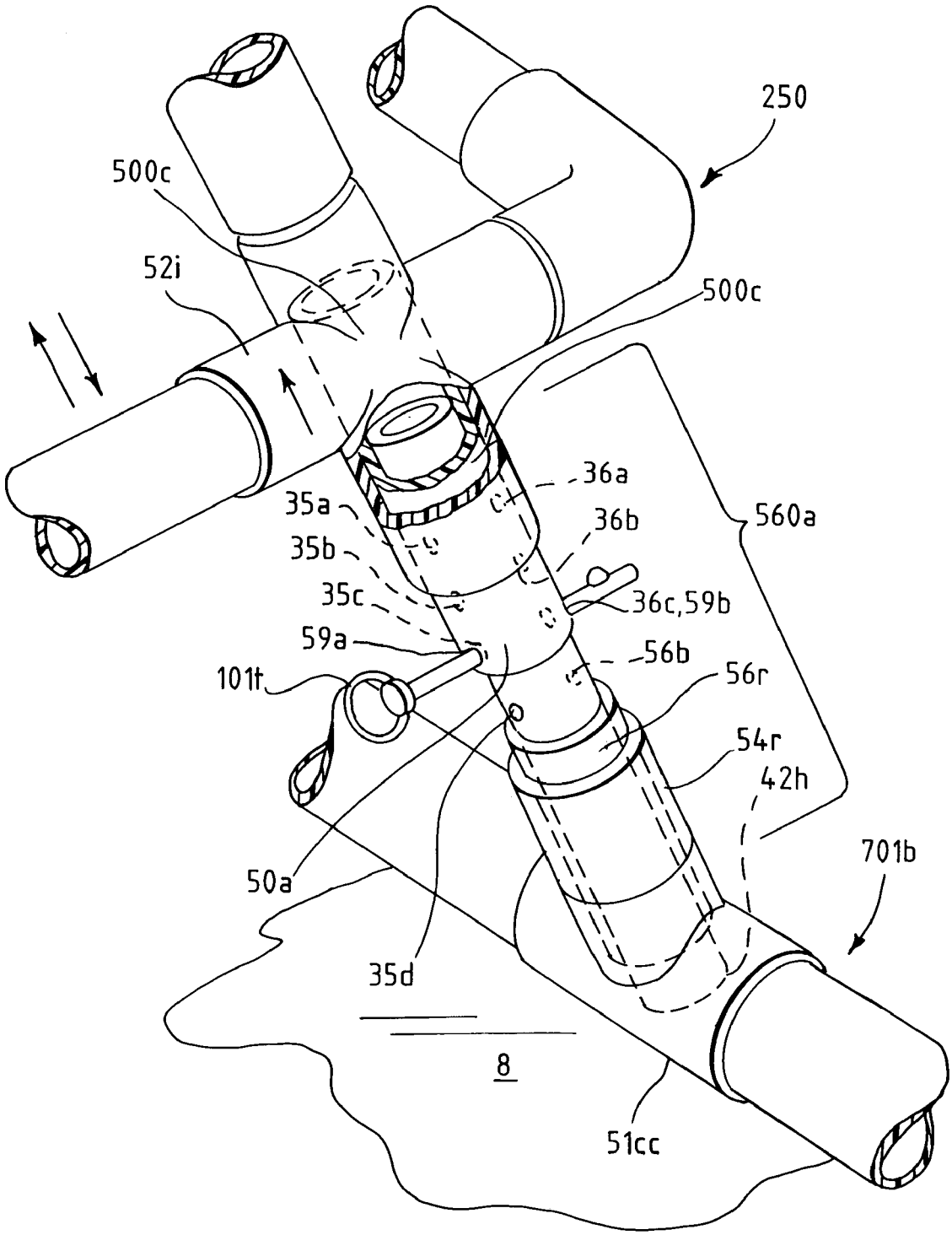
FIG. 19B: Partial lateral close-up view of one adjuster bar with pin attachment within lower slanted framework.

Referring now to FIGS. 19A and 19B, removably inserted within first and second parallel slanted support pipes 500*c*, 500*d* are first and second angled long adjuster bars 560*a*, 560*b* respectively. Long angled adjuster bars 560*a* 560*b*, change the angle of lower slanted framework 250 to rigid horizontal support surface 8. Although FIG. 19B only shows long angled adjuster bar 560*a*, the structure and operation of long angled adjuster bar 560*b* is the same.

Each long angled adjuster bar 560*a*, 560*b* is permanently adhered at each respective lower end within a smaller diameter adjuster pipe segment 56*r*, 56*rr* respectively. Each smaller diameter adjuster pipe segment 56*r*, 56*rr* is permanently adhered within:

(i) first and second adjoining slanted linear connectors 54*r*, 54*rr* respectively, and (ii) first and second slanted t-joint connectors 51*cc*, 51*ccc* respectively, along transverse connecting bar 701.

Each first angled adjuster bar 560*a* and second angled adjuster bar 560*b* is cylindrical. Each first and second angled adjuster bar 560*a*, 560*b* contains first and second linearly aligned opposing adjuster sets of pinholes 35*a*, 35*b*, 35*c*, etc. and 36*a*, 36*b*, 36*c*, etc. (generically adjuster pinholes 35, 36). Adjuster pinhole sets 35, 36 oppose each other at approximately 180 degrees apart along each respective angled adjuster bar 560*a*, 560*b*.

However, more than two pinhole sets per adjuster bar 560*a*, 560*b* are also within the scope of my invention. Adjuster pinholes 35 or 36 in each first and second angled adjuster bars 560*a*, 560*b* are approximately ½ inch apart from adjacent pinholes 35, 36 in each corresponding linear vertical alignment 35, 36 respectively. As seen in FIG. 19B, in each slanted support pipe 500*c*, 500*d* into which each adjuster bar 560*a*, 560*b* respectively inserts, there are corresponding first and second pipe edge apertures 59*a*, 59*b* respectively.

The user congruently aligns slanted support pipe apertures 59*a*, 59*b* with pinhole pairs, such as pinholes 35*a*/36*a* or 35*b*/36*b*, etc., within each long angled adjuster bar 560*a*, 560*b*. This adjustment changes the angle and height of slanted framework 250 to horizontal support surface 8. For example, each slanted support pipe 500*c*, 500*d* is manually raised, until each of their respective pinhole sets 35*c*/36*c* are congruent with corresponding slanted support pipe apertures 59*a*, 59*b*.

The lower edge of each slanted support pipe 500*c*, 500*d* comprises first and second opposing apertures 59*a*, 59*b* respectively. The user inserts a long rounded detente pin 101*t* through both apertures 59*a*, 59*b* and predetermined adjuster pinhole sets 35*c*, 36*c*, such as 35*c*, 36*c*, etc. Pin 101*t* is a backstop and holds slanted support pipes 500*c*, 500*d* rigid at a second predetermined position. Long angled adjuster bars 560*a*, 560*b* always remain permanently adhered and immobile at lower ends 42*h*, 42*hh* respectively.

On the other hand, upper ends of slanted support pipes 500*c*, 500*d* always remain attached to lower slanted framework 250. In this manner, it is actually lower slanted framework 250 attached to slanted support pipes 500*c*, 500*d*, which is raised or lowered manually (to align bar pinholes 35, 36 with slanted support pipe apertures 59*a*, 59*b*). Adjustment ceases when appropriate adjuster pinholes 35,36 are congruently aligned, and engaged through opposing apertures 59*a*, 59*b* by long metal detente pin 101*t*.

Use of Lower Slanted Framework 250 in Combination with Modified AB Challenger Apparatus 101

My lower slanted framework 250 is specially designed for persons with lower back pain and/or neck pain. However, a healthy individual without physical ailment or limitations can also use it advantageously. The slanted framework 250 is aligned and centered between the two base supports of the AB challenger device 11.

For optimal results, the user places his or feet on top of the horizontal footstand bar 22. For appropriate speedbag or basketball rim height, the user must curl his or her upper body without lifting the lower back from lower slanted framework 250. Therefore, the user must place his feet firmly upon horizontal footstand bar 22.

Pipe Construction

Horizontal and vertical support pipes are preferably made from 1 and ¼" diameter PVC pipe, while vertical support pipes are preferably made from ¾" diameter PVC pipe. Pipes are preferably cylindrical in shape, although other shapes are also acceptable. In my preferred embodiment each PVC pipe diameter should be such that it is reversibly removable from appropriate connectors.

Polyvinylchloride (PVC) piping for the preferred embodiment is available from:

Bristol Pipe
P.O. Box 609
503 East Vistula St.
Bristol, Ind. 46507
1-800-348-7671

Diameters of different pipes may also range from approximately 1 and ½ inches to approximately 1(one) inch in other embodiments of my invention. Other materials of appropriate strength and rigidity are also within the scope of my modified AB Challenger with or without lower slanted framework 250. For example, plastic, aluminum, stainless steel and wood are satisfactory. Pipes are preferably completely hollow in the preferred embodiment. However, such cylindrical and other shaped pipes need not be hollow, if the pipes are not cumbersome and cost-prohibitive.

In particular, the preferred embodiment comprises PVC pipes lined with blue-green lightweight plastic. These two-ply pipes are obtainable from:

Available Plastics, Inc.
Huntsville, Ala.
Phone: 256-859-4957
Model Nos. 22290: ¼ inch diameter by 60-inch length 22390;22490: 90 degree angled connectors These two-ply pipes are more expensive than conventional PVC pipes by fifty cents per 60-inch length unit. However, the advantage of two-ply pipes is that they are lighter weight than conventional PVC pipe of the same diameter, length, and wall thickness. There is no special adhesive requirement for these two-ply pipes.

Connectors

Referring now to FIGS. 18A-18G, my modified AB Challenger exercise apparatus 11 comprises numerous connectors along each pipe or bar. These connectors preferably comprise prefabricated rigid PVC cylindrical units in the preferred embodiment including: t-joint connectors 51, angled connectors 53, four member cross connectors 52, two-end linear connectors 54, coffee cup connectors 56, and oblique angled connectors 57. Connectors 51, 52, 53 and 54 are also present in lower slanted framework 250.

Connectors can also be made of aluminum, other light metals, plastics with sufficient rigidity and strength, or other appropriate materials. T-joint connectors 51 are approximately 1 and ½ inches diameter and approximately four to six inches in height in the preferred embodiment. Coffee cup connectors 56 have two circular openings 44*a*, 44*b* at approximately 180 degrees from each other.

Figure 18A:
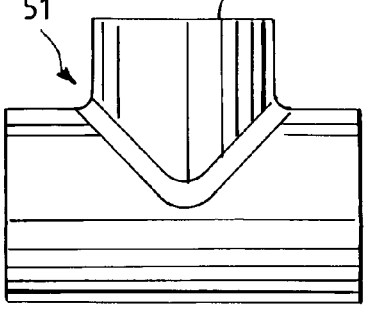
FIG. 18A: Lateral view of a t-joint connector.
Figure 18C:
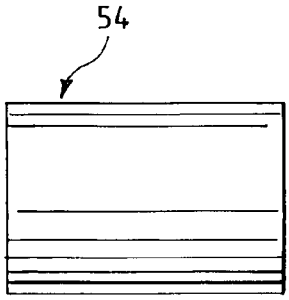
FIG. 18C: Lateral view of a two-ended linear connector.
Figure 18D:
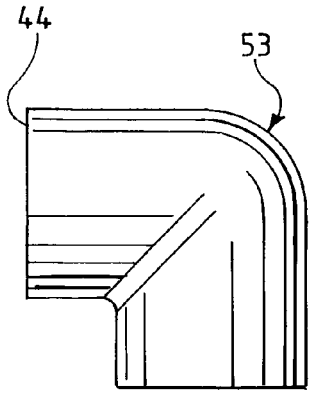
FIG. 18D: Lateral view of an angled connector.
Figure 18B:
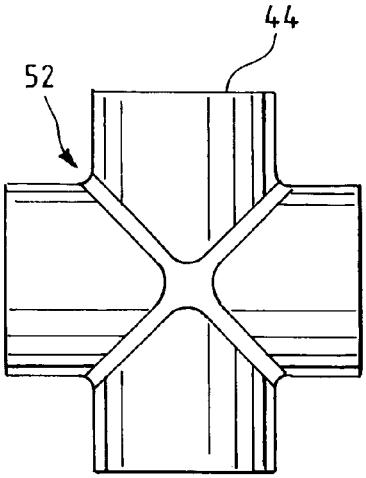
FIG. 18B: Lateral view of a four-member cross connector.
Figure 18E:
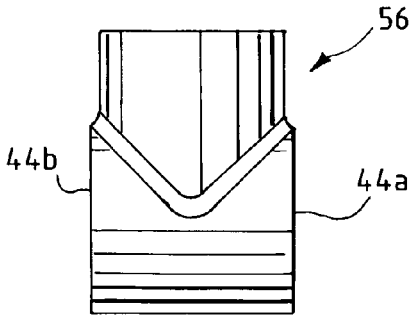
FIG. 18E: Lateral view of a coffee-cup connector.
Figure 18G:
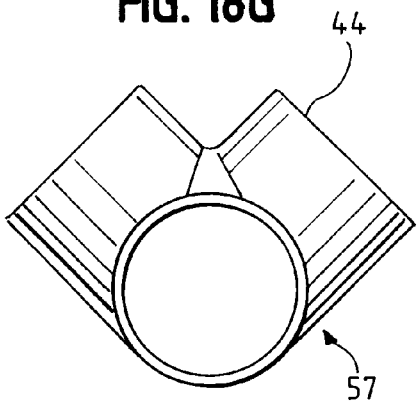
FIG. 18F: Partial plan view of four opening oblique connector.
Figure 18F:
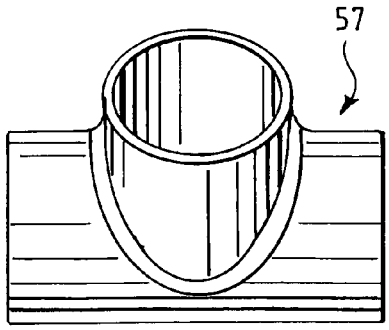

Each prefabricated angled connector 53 has an angle of approximately 60 degrees at approximately the center of the connector. As seen in FIG. 18B, four member cross connectors 53 are most suitable for horizontal and vertical attachments. Each of these connectors comprises at least two openings 44, which hold, in a female relation, an end of a pipe or adjuster bar.

Prefabricated polyvinylchloride connectors, as well as other connectors and fittings, are available from:

NIBCO Hardware Market
1516 Middlebury
Elkhart, Ind. 46515-1167
Phone: 219-295-3305

Other lengths and diameters of connectors are also within the scope of my invention, and connectors need not be prefabricated in other embodiments. The diameter of each hollow cylindrical connector opening 44 is approximately 1 and ½ inches. Preferred use of connectors are labeled throughout the attached drawings.

Assembly and Color Coding

Assembly or disassembly of my modified AB Challenger exercise apparatus 101 and/or lower slanted framework 250 only requires a few minutes of manual adjustment. There are circular color-coded bands upon upwardly protruding connectors and other components. The user matches the same color ends of individual components to connectors with similar colors, as well as other appropriate assembly points.

My preferred embodiment incorporates the following color code:

Red tape color banding
Black tape color banding;
Blue tape color banding;
Green tape color banding;
Orange tape color banding; and
Brown tape color banding.

For example, first and second pivoting arm grips 75*a*, 75*b* comprise orange color banding, as do each corresponding connector along each parallel base bar 3*a*, 3*b*. The user then knows immediately where to insert detachable pivoting armgrips 75*a*, 75*b*, as well as the detachable upper portions of armgrips 75*a*, 75*b*, which are also color coded orange.

Similarly, red banding appears upon the lower end of each upwardly protruding rigid vertical speedbag support bar 41*a*, 41*b*. There is a corresponding red band on the t-joint connector 51 into which each detachable vertical speedbag support bar 41*a*, 41*b* inserts. Green banding on the lowest end of each vertical footstand 20 support pipe 79*a*, 79*b* corresponds to green banding upon t-joint connector 51 into which each support pipe 79*a*, 79*b* reversibly inserts.

Other detachable points in my preferred embodiment for self-assembly include the horizontal footstand support bar 22 and horizontal speedbag support bar 190. However, these examples in the preferred embodiment do not limit other possible assembly points or color-coding in other embodiments of my exercise apparatus 11. These examples also do not limit the other possibilities for reversibe attachment assembly points.

P4 PVC Cement

To permanently attach components of my invention into different assembly pieces, P4 PVC cement is the adhesive of choice in the preferred embodiment. P4 PVC cement is available from:

William H. Harvey Company
4334 South 67th Street
Omaha, Nebr. 68117-1019
Phone: 402-331-1175; 1-800-228-9681

As of Jun. 1, 1999, P4 PVC cement (product name HV P-4 Regular PVC Cement, chemical name PVC solvent cement) from William H. Harvey Company has the following physical characteristics:

1. boiling point: 146 degrees Fahrenheit
2. vapor pressure (mm. Hg) 86
3. vapor density (air=1)2.5
4. solubility in water: moderate
5. appearance and odor: slightly viscous clear liquid with ketone odor
6. evaporation rate (butyl acetate=1)5.7

Components of P4 PVC cement comprise, but not exclusively, tetrahydrofuran, methylethyl ketone and cylclohexanone.

Another satisfactory clear PVC solvent cement is manufactured by:

Oatey®
4700 West 160th Street
Cleveland, Ohio 44135,www.oatey.com
Phone: 1-800-321-9532

As of Jul. 3, 2002 Oatey® cement had the following physical and chemical properties:

1. Boiling point: 151 degrees F., 66 degrees C.
2. Vapor pressure: 145 mmHg @ 20 degrees C.
3. Vapor Density (air=1) 2.5
4. Solubility in water: negligible
5. Specific gravity: 0.89+ or minus 0.015
6. Evaporation rate: (BUAC–1)=5.5–8.0
7. Odor: ether-like
8. Soluble in tetrahydrofuran
9. Material is liquid
10. Ingredients include: non-hazardous PVC resin 10%-16%; methyl ethyl ketone 45-60%, tetrahydrofuran 25-40%; cyclohexanone 5-10%; acetone 0-5%.

CONCLUSIONS

My modified AB Challenger exercise apparatus 11 is light, easily collapsible, economical, and it is easily assembled and used in a small space such as an apartment. In addition to these advantages, the exercises are effective for improving stomach muscles, and no nails, screws or additional adhesives are required for assembly.

Accordingly, since my invention may be embodied in specific forms without departing from the spirit or essential characteristics thereof, the present embodiment is in all respects illustrative and not restrictive. The scope of my invention is indicated by the appended claims rather than by the foregoing description. All changes which come within the meaning and range of equivalency of the claims are intended to be included therein.

I claim:

1. An exercise apparatus, said exercise apparatus comprising an anterior and a posterior, said exercise apparatus comprising:

(A) A base comprising (1) a first rigid anterior/posterior parallel base bar and a second rigid anterior/posterior parallel base bar, each said rigid anterior/posterior parallel base bar comprising an upper surface and a lower surface, each said anterior/posterior parallel base bar further comprising:

(a) an angled interior opposing extension bar, (b) an exterior angled segment, (c) circular rubber grips positioned along said lower surface, and (d) an angled interior opposing extension bar, said base further comprising a horizontal base bar with two horizontal ends, said horizontal base bar connected to said first and said second anterior/posterior parallel base bars at said horizontal ends, said horizontal base bar positioned posterior to said horizontal anterior/posterior parallel base bars, said first and second interior opposing extension bars and said first and second exterior angled segments positioned most anterior along each said horizontal base bar respectively, and (2) upwardly protruding vertical components rigidly attached along each anterior/posterior parallel base bar upper surface, said upwardly protruding components comprising (a) a first pivoting arm grip and second pivoting arm grip, each said pivoting arm grip attached posterior to said angled exterior segment, (b) a first adjacent angled support pipe and a second adjacent angled support pipe, each said adjacent angled support pipe attaching posterior to said corresponding pivoting arm grip, (c) a first upwardly protruding rigid vertical speed bag support pipe and a second upwardly protruding rigid vertical speed bag support pipe, each said upwardly protruding rigid vertical speed bag support pipe attaching to said anterior/posterior parallel base bar posterior to said corresponding adjacent angled support pipe, (d) a first vertical foot stand support bar and a second vertical foot stand support bar, each said vertical foot stand support bar and vertical speed bag support bar connecting rigidly to each other, each vertical foot stand support pipe attaching posterior to said corresponding vertical speed bag support pipe along said upper surface, and (e) one horizontal foot stand support bar, said horizontal foot stand support bar comprising a first end and a second end, said horizontal foot stand support bar positioned above said anterior/posterior parallel base bars, each said vertical foot stand support bar attaching to said horizontal foot stand support bar by said first bar end and said second bar end, said horizontal foot stand support bar being vertically adjustable, (B) An upper portion, said upper portion comprising (1) one rigid horizontal rigid speed bag support bar, said horizontal rigid speed bag support bar attached to said first and second vertical speed bag support bars, said horizontal rigid speed bag support bar positioned parallel to a rigid horizontal supporting surface, said horizontal speed bag support bar positioned above and perpendicular to said base, (2) a common stem, said common stem enclosing said horizontal rigid speed bag support bar, said horizontal rigid speed bag support bar lying directly beneath and perpendicular to said common stem, said common stem comprising an anterior circular edge, said anterior circular edge comprising two opposing apertures, (3) a first swivel adjuster bar and a second swivel adjuster bar, each said swivel adjuster bar mechanically attached to said horizontal rigid speed bag support bar, each said swivel adjuster bar being physically separated from and unattached to each other, each said swivel adjuster bar being physical separated from and unattached to said common stem, each swivel adjuster bar consisting of a pin and aperture attachment, each said swivel adjuster bar adapted to rotate, (4) a first lateral prong and a second lateral prong, each said lateral prong protruding from said horizontal speed bag support bar, each said lateral prong mechanically attached to said horizontal rigid speed bag support bar by one corresponding said swivel adjuster bar within a four opening cross connector, each said lateral prong being physically separated from and unattached to the other, each said lateral prong being physically separated from and unattached to said common stem, said first lateral prong and said second lateral prong being identical in structure and function to each other, (5) lateral prong speed bag attachment structures, said lateral prong speed bag attachment structures being physically separate from and unattached to said common stem, said lateral prong speed bag attachment structures being identical to each other in structure and function, (6) a central speed bag attachment structure, said central speed bag attachment structure reversibly inserting within said common stem, said central speed bag attachment structure being structurally dissimilar from said lateral speed bag attachment structures, said central speed bat attachment structure inserting only within said common stem, (7) modified speed bags, said modified speed bags reversibly attaching to said lateral prongs and said common stem by said lateral speed bag and central speed bag attachment structures respectively (8) basketball rim attachment structures, said basketball rim attachment structures comprising lateral basketball rim attachment structures, and a central basketball rim attachment structure, said lateral basketball rim attachment structures being identical to each other in structure and function, said central basketball rim attachment structure being structurally dissimilar from said lateral basketball rim attachment structures, said central basketball rim attachment structure attaching only to said common stem, (9) a modified basketball rim and modified basketball rim attachment structure, said modified basketball rim attaching only to said common stem,

(10) a double vertical basketball rim and double vertical basketball rim attachment structure, said double vertical basketball rim attachment structure attaching only to a common stem, (9) conventional basketball rims, said conventional basketball rims reversibly attaching to said lateral prongs and said common stem by said lateral basketball rim attachment structures and said central basketball rim attachment structure, whereby said base attaches to said upper portion by said upwardly protruding rigid vertical components, said vertical speed bag support bars supporting said horizontal rigid speed bag support bar, said horizontal rigid speed bag support bar supporting said attaching modified speed bags and conventional basketball rims, said vertical speed bag support bars adapted to change the vertical height of said modified speed bags and said basketball rims, said speedbag attachment structures and said basketball rim attachment structures being reversibly and interchangeably attached to said lateral prongs and said common stem, said speedbag attachment structures with said modified speedbags and said basketball rim attachment structures with said basketball rim attachments not all attached to said common stem and said lateral prongs simultaneously.

2. The exercise apparatus as described in claim 1 wherein said exercise apparatus comprises rigid polyvinyl chloride pipes and prefabricated rigid polyvinyl chloride rigid connectors.

3. The exercise apparatus as described in claim 2 wherein each said modified speed bag comprises a spring and vertical speed bag support bar comprises a rigid connector, said rigid connector reversibly receiving said first and second horizontal ends of said horizontal speed bag support bar.

4. The exercise apparatus as described in claim 3 wherein said horizontal speed bag support bar comprises short alternating enclosed pipe segments, and said conventional basketball rim attachments comprise particle board squares.

5. The exercise apparatus as described in claim 4 wherein each said lateral conventional basketball rim contains a spring.

6. The exercise apparatus as described in claim 5 wherein said exercise apparatus comprises an adhesive.

7. The exercise apparatus as described in claim 6 wherein each said lateral speed bag attachment structure reversibly attaches to a corresponding connector at the proximate end of each said lateral prong, said lateral speed bag attachment structure attaching to said proximate end with a detente pin.

8. The exercise apparatus as described in claim 7 wherein said rigid upwardly protruding components are reversibly inserted within rigid connectors along said upper surface of each said anterior-posterior base bar, said upwardly protruding components and corresponding rigid connectors further comprising color coded bands.

9. The exercise apparatus as described in claim 8 in combination with functional reclining multipurpose exercise apparatus, said multipurpose exercise apparatus comprising removable leg attachments, said multipurpose exercise apparatus further comprising adjuster bars and pin attachments, said functional reclining multipurpose exercise apparatus being spatially and physically separate from said exercise apparatus.

10. The exercise apparatus as described in claim 8 wherein each said lateral speed bag attachment structure comprises rigid connectors and short pipe segments, said short pipe segments further comprising tubular protrusions, said tubular protrusion further comprising a screw.

11. The exercise apparatus as described in claim 10 wherein said central speed bag pin attachment structure comprises a long speed bag connecting bar, said long speed bag connecting bar adapted to insert within said common stem, said central speed bag pin attachment structure further comprising two opposing rows of linearly aligned pinholes, said central speed bag pin attachment structure further comprising a long pin which inserts through said two opposing rows of linearly aligned pinholes and said congruently aligned pinholes within said common stem.

12. The exercise apparatus as described in claim 11 wherein said first lateral basketball rim and said second lateral conventional basketball rim are each positioned interior to, and more centrally than its corresponding said lateral prong along said rigid horizontal speed bag support bar.

13. An exercise apparatus as described in claim 12 wherein said long hollow basketball rim connecting pipe comprises an anterior end, said long hollow basketball rim connecting pipe attaching to a particleboard square, said particleboard square attaching to a backboard, said anterior end of said long hollow basketball rim connecting pipe flush with said particleboard square.

14. An exercise apparatus comprising:

(A) A base comprising an anterior and a posterior, said base further comprising (1) a first anterior-posterior parallel base bar and a second anterior-posterior parallel base bar, and (2) a horizontal base bar, said horizontal base bar connected only to said first and said second anterior/posterior parallel base bars, said horizontal base bar positioned along said posterior, (2) vertical components, said vertical components comprising (a) a first pivoting arm grip and a second pivoting arm grip, said first pivoting arm grip protruding upwardly from said anterior end of said first anterior-posterior parallel base bar within a rigid connector, said second pivoting arm grip protruding upwardly from said anterior end of said second anterior-posterior parallel base bar within a rigid connector, (b) a first vertical foot stand support bare and a second vertical foot stand support bar, said first vertical foot stand support bar protruding upwardly from said first parallel anterior-posterior base bar, said second vertical foot stand support bar protruding upwardly from said second parallel anterior-posterior base bar, (c) a horizontal foot stand support bar, said horizontal foot stand support bar further comprising a first bar end and a second bar end, whereby each said vertical foot stand support bar attaches to said horizontal foot stand support bar by said first bar end and said second bar end, and (d) a first vertical speed bag support bar and a second vertical speed bag support bar, said first vertical speedbag support bar protruding upwardly from said first parallel anterior-posterior base bar, said second vertical speed bag support bar protruding upwardly from said second parallel anterior-posterior base bar, whereby said first vertical foot stand support bar and said first vertical speed bag support bar along said first parallel anterior-posterior base bar rigidly attach to each other, and said second vertical foot stand support bar and said second vertical speed bag support bar along said second parallel anterior-posterior base bar rigidly attach to each other, (B) An upper portion, said upper portion comprising (1) a horizontal rigid speed bag support bar, said horizontal rigid speed bag support bar comprising a first end and a second end, said horizontal rigid speed bag support bar attached to said first and second vertical speed bag support bars by said first and second ends, said horizontal rigid speed bag support bar positioned parallel to a rigid horizontal supporting surface, said horizontal rigid speed bag support bar positioned above and perpendicular to said base, said horizontal rigid speed bag support bar comprising kinks, (2) a common stem, said common stem attached to said horizontal rigid speed bag support bar, said horizontal rigid speed bag support bar lying directly beneath and perpendicular to said common stem, said common stem consisting solely of rigid connectors and short pipe segments, (3) a first swivel adjuster bar and a second swivel adjuster bar, each said swivel adjuster bar mechanically attached to said horizontal rigid speed bag support bar, each swivel adjuster bar being cylindrical in shape, said swivel adjuster bar comprising pinholes, each said swivel adjuster bar adapted to rotate, each said swivel adjuster bar being physically, functionally and structurally separate from said common stem, each swivel adjuster bar rotating within a rigid connector, (4) a first lateral prong and a second lateral prong, each said lateral prong protruding from said horizontal speed bag support bar, each said lateral prong being physically separate and distinct from the other said lateral prong, each said lateral prong being physically, structurally and functionally separate and independent from said common stem, each lateral prong further comprising a rigid four opening cross connector, each said lateral prong enclosing said corresponding swivel adjuster bar, each said lateral prong being identical in structure and function to the other said lateral prong, (5) lateral speed bag attachment structures, each said lateral speed bag attachment structure being identical in structure and function to the other said lateral speed bag attachment structure, each said lateral speed bag attachment structure comprising rigid connectors and short pipe segments, each said lateral speed bag attachment structure reversibly attaching to each corresponding said lateral prong, (6) a central speed bag attachment structure, said central speedbag attachment structure comprising a long speed bag connecting bar, said long connecting bar reversibly inserting within said common stem, (7) modified speed bags, said modified speed bags comprising lateral modified speedbags and a central modified speedbag, each said lateral modified speed bag reversibly attaching to a said corresponding lateral prong by one said lateral speed bag attachment structure, said central modified speedbag reversibly attaching to said common stem by said central modified speedbag attachment structure, said speedbag attachment structures being removable from said rigid horizontal speedbag support bar, (8) conventional basketball rim attachment structures, said conventional basketball rim attachment structures comprising lateral basketball rim attachment structures and a central basketball rim attachment structure, said lateral basketball rim attachment structures being interchangeable with said lateral speedbag attachment structures on said lateral prongs, said central basketball rim attachment structure being interchangeable with said central basketball speedbag attachment structure within said common stem, said conventional basketball rim attachment structures being removable from said rigid horizontal speedbag support bar, (9) three conventional basketball rims, said conventional basketball rims reversibly 15 attaching to a said corresponding lateral prong by a said lateral basketball rim speed bag attachment structure, said conventional basketball rim attaching to said common stem by said central basketball rim attachment structure, whereby said base attaches to said rigid vertical components, said vertical speed bag support bars attaching to and supporting said horizontal rigid speed bag support bar, said horizontal rigid speed bag support bar supporting said speed bags and basketball rims attached to said lateral prongs and common stem by said speed bag attachment structures and said conventional basketball rim attachment structures.

15. The exercise apparatus as described in claim 14 wherein said modified speedbag comprises a screw within a spring, a rigid plastic core and a larger plastic speedbag wrapping with cotton batting.

16. The exercise apparatus as described in claim 15 wherein said central speed bag attachment structure comprises a long connecting pipe enclosing a protruding smaller diameter pipe segment.

17. The method of using an exercise apparatus,

A. Said exercise apparatus comprising 1. two anterior-posterior parallel base bars upon a rigid horizontal surface, each anterior-posterior parallel base bar comprising an upwardly protruding pivoting arm grip, each said anterior-posterior parallel base bar comprising two rigid vertical speed bag support pipes, said vertical speed bag support pipes each comprising a vertical support pipe adjuster bar, 2. said exercise apparatus further comprising a. a common stem, b. swivel adjuster bars, c. a rigid horizontal speed bag support bar, said rigid horizontal speed bag support bar comprising short rigid pipe segments, c. lateral prongs, said lateral prongs attaching to said rigid horizontal speed bag support bar by said swivel adjuster bars, said lateral prongs being structurally and functionally unattached to and unconnected to said common stem;

d. three speed bags, said speed bags mechanically and reversibly connected to said rigid horizontal speedbag support bar, said speed bags comprising two lateral speed bags and one central speed bag, said lateral speedbags being vertically and laterally adjustable anterior to said rigid horizontal speed bag support bar by said vertical speed bag support bars and swivel adjuster bars, said central speed bag being vertically and anterior/posterior adjustable anterior to said rigid horizontal speed bag support bar by a long speed bag connecting pipe, said long speed bag connecting pipe reversibly inserting within said common stem;

said rigid horizontal speed bag support bar adapted to be vertically adjustable when attached to said vertical speed bag support pipes by said vertical adjuster bars, said common stem enclosing said rigid horizontal speed bag support bar, said long connecting pipe mechanically attaching said central speed bag to said common stem, said method of use by an individual comprising the steps of (1) reclining and facing said attached speed bags at the anterior of said exercise device, (2) raising the upper body and punching one said lateral speed bag, (3) immediately punching said central speed bag two times prior to reclining again, (4) repeating the same movement a second and third time by punching the central, left lateral, central, and right lateral positioned speed bag in sequence, thereby gradually increasing the number and speed of complete sequential punching movements.

18. The method of assembly of an exercise apparatus, said method comprising matching the color coded bands of rigid connectors to color coded bands of rigid upwardly protruding vertical components, inserting the color coded end of said corresponding rigid upwardly protruding vertical component into said corresponding color coded end of a rigid connector, said exercise apparatus comprising a base, said base comprising a first anterior-posterior parallel base bar and a second anterior-posterior parallel base bar, each said anterior-posterior parallel base bar being parallel to the other, each said anterior-posterior parallel base bar comprising rigid pre-fabricated connectors, each said prefabricated connectors comprising a colored band, each anterior-posterior parallel base bar connected to a plurality of rigid upwardly protruding vertical components, said upwardly protruding vertical components comprising colored bands, said upwardly protruding vertical components further comprising a first rigid vertical speed bag support bar and a second rigid vertical speed bag support bar, each said rigid vertical speed bag support bar comprising a colored band, a first detachable arm grip and a second detachable arm grip, each said first detachable arm grip and second detachable arm grip comprising a colored band, said exercise apparatus further comprising a rigid horizontal speed bag support bar, said rigid horizontal speed bag support bar comprising colored bands, said rigid horizontal speed bag support bar attaching to said vertical speed bag support bars, said rigid horizontal speed bag support bar comprising the same color bands as said rigid vertical speed bag support bars.

19. The exercise apparatus as described in claim 14 wherein said exercise apparatus further comprises:

(A) a modified wider basketball rim, said modified wider basketball rim comprising a wider diameter, said modified wider basketball rim comprising braided flexible cords and a hinge-like member, said modified wider basketball hoop lacking a spring, and (B) a modified wider basketball rim attachment structure, said modified wider basketball rim attaching to said modified wider basketball rim attachment structure, and (C) a central prong/anterior-posterior adjuster bar, said wider basketball rim attachment structure reversibly connecting to said central prong/ anterior-posterior adjuster bar, said combined central prong/anterior-posterior adjuster bar and modified wider basketball rim attachment structure with attached modified wider basketball rim reversibly inserting within said common stem, said modified wider basketball rim attachment structure attached to said central prong/anterior-posterior adjuster bar being interchangeable with said central conventional basketball rim attachment structure and said central speedbag attachment structure.

20. The exercise apparatus of claim 14 wherein said exercise apparatus comprises a double vertical basketball rim, said double vertical basketball rim connecting to a double vertical basketball rim attachment structure, said double vertical basketball rim attachment structure being reversibly interchangeable with said central speedbag attachment structure and said central basketball rim attachment structure within said common stem.

* * * * *